US005309206A

United States Patent [19]

Deishi et al.

[11] Patent Number: 5,309,206

[45] Date of Patent: May 3, 1994

[54] DEVELOPING DEVICE BROUGHT INTO CONTACT WITH AN ELECTROSTATIC LATENT IMAGE SUPPORT MEMBER

[75] Inventors: Satoshi Deishi, Amagasaki; Hiroshi Mizuno, Ikoma; Toshimitsu Fujiwara, Kobe; Toshiya Natsuhara, Nishinomiya; Masami Matsuura; Hideo Yamaki, both of Isehara; Hideaki Hirahara, Ayase, all of Japan

[73] Assignee: Minolta Camera Kabushiki Kaisha, Osaka, Japan

[21] Appl. No.: 887,134

[22] Filed: May 22, 1992

[30] Foreign Application Priority Data

| | | | |
|---|---|---|---|
| May 24, 1991 | [JP] | Japan | 3-120185 |
| May 29, 1991 | [JP] | Japan | 3-124375 |
| May 29, 1991 | [JP] | Japan | 3-124376 |
| May 29, 1991 | [JP] | Japan | 3-124377 |
| May 29, 1991 | [JP] | Japan | 3-124378 |
| Oct. 18, 1991 | [JP] | Japan | 3-270923 |

[51] Int. Cl.[5] ..... G03G 21/00

[52] U.S. Cl. ..... 355/246; 118/651; 355/259

[58] Field of Search ..... 355/245, 246, 251, 259, 355/250, 253; 118/651, 656, 661, 647, 644, 653

[56] References Cited

U.S. PATENT DOCUMENTS

| | | | |
|---|---|---|---|
| 4,100,884 | 7/1978 | Mochizuki et al. | 118/653 |
| 4,292,387 | 9/1981 | Kanbe et al. | 430/102 |
| 4,445,771 | 5/1984 | Sakamoto et al. | 355/259 |
| 4,791,882 | 12/1988 | Enoguchi et al. | 118/653 |
| 4,809,036 | 2/1989 | Yamashita et al. | 355/259 |
| 4,838,200 | 6/1989 | Hosoi et al. | 355/251 X |
| 4,841,332 | 6/1989 | Haneda et al. | 355/251 |
| 4,883,017 | 11/1989 | Yuji et al. | 355/259 X |
| 4,920,916 | 5/1990 | Mizuno et al. | 118/653 |
| 4,984,022 | 1/1991 | Matsushita et al. | 355/246 |
| 5,052,335 | 10/1991 | Enoguchi et al. | 355/253 X |
| 5,080,037 | 1/1992 | Nakagawa et al. | 355/245 X |
| 5,124,753 | 6/1992 | Asai et al. | 118/656 X |
| 5,206,691 | 4/1993 | Mizuno et al. | 118/653 X |

*Primary Examiner*—A. T. Grimley
*Assistant Examiner*—Shuk Y. Lee
*Attorney, Agent, or Firm*—Burns, Doane, Swecker & Mathis

[57] ABSTRACT

A developing device comprising: a drive roller which is driven so as to be rotated; a developing sleeve which is formed by a thin film and has a peripheral length slightly larger than that of the drive roller so as to be fitted around the drive roller; a press member which presses the developing sleeve against the drive roller at one side of the drive roller so as to form a sag portion of the developing sleeve such that the sag portion is brought into contact with an electrostatic latent image support member; and an electric field forming member for forming alternating electric field such that an attractive force capable of bringing the developing sleeve and the electrostatic latent image support member into contact with each other is applied between the developing sleeve and the electrostatic latent image support member.

18 Claims, 24 Drawing Sheets

DEVELOPING DEVICE BROUGHT INTO CONTACT WITH AN ELECTROSTATIC LATENT IMAGE SUPPORT MEMBER

BACKGROUND OF THE INVENTION

The present invention relates to a developing device for use in image forming apparatuses such as a copying apparatus, a printer, etc.

When an image is formed by image forming apparatuses such as a copying apparatus, a printer, etc., an electrostatic latent image is initially formed on a surface of an electrostatic latent image support member for supporting the electrostatic latent image, usually a photosensitive member. Then, charged toner is supplied to the surface of the electrostatic latent image support member by a developing device so as to develop the electrostatic latent image into a visual toner image. Subsequently, the obtained toner image is transferred onto a transfer medium such as a paper sheet by a transfer device and is fixed on the transfer medium by a fixing device.

The developing device used in such image forming apparatus is of several types. Particularly, in a developing device in which a thin layer of developer is formed on a developer support member such as a developing roller so as to be brought into contact with the electrostatic latent image support member, it is essential that the thin layer of the developer should be supplied uniformly. A developer regulating blade for forming the thin layer of the developer is required to be brought into contact with a surface of the developing roller at a predetermined pressing force or more. Thus, the developing roller should have a relatively high hardness. Meanwhile, at a contact area between the developing roller and the electrostatic latent image support member, it is desirable that hardness of the developing roller be minimized in order to prevent damage to the electrostatic latent image support member and marring of an image.

In order to solve the above described problem of the known developing device, Japanese Patent Laid-Open Publication No. 63-226676 (1988) proposes a developing device in which at a toner supply area, uniform charging of toner and uniform formation of a thin layer of the toner are improved by securing a sufficiently large pressing force between a toner support member for development and a means is such as a blade for forming the thin layer of the toner, while at an area having an electrostatic latent image support member and the toner support member confronting each other, the toner is supplied to an electrostatic latent image by holding the toner support member in contact with the electrostatic latent image support member at a proper light pressing force stably.

However, also in this prior art developing device, such a case as shown in FIG. 12 may happen in which since a longitudinally central portion SLC of a thin film member SL is curved concavely at the area having the thin film member SL and the electrostatic latent image support member PC confronting each other, it is difficult to uniformly hold the thin film member SL and the electrostatic latent image support member PC in contact with each other. Namely, the cylindrical thin film member SL is generally made of metal, for example, nickel by electroforming or the like. However, the thin film member SL made of metal has such drawbacks that the production is complicated and expensive, the thin film member SL is likely to be cracked at its opposite end portions, the thin film member SL is readily damaged when struck by an object and the thin film member SL is apt to be affected by ozone or the like emitted from a charger of a copying apparatus, etc. In view of these drawbacks of the thin film member SL made of metal, it is proposed that the thin film member SL be made of synthetic resin in place of metal. In the case where the thin film member SL is made of synthetic resin, concave curving of the central portion SLC of the thin film member SL is likely to take place as shown in FIG. 12 more conspicuously than a case in which the thin film member SL is made of metal, thereby resulting in a defective image having skipped spots such as central skipped spots or thin spots. Even if the thin film member SL is made of metal, it is difficult to bring the thin film member SL into contact with the electrostatic latent image support member PC stably and uniformly when thickness of the thin film member SL is small.

Furthermore, the prior art developing device has such problems that the thin film member is required to have high machining accuracy and high assembly accuracy and position of contact of the thin film member with the electrostatic latent image support member is restricted. In addition, if the thin film member is allowed to stand in contact with the electrostatic latent image support member, the thin film member is deformed. As a result, noncontact state may partially appear between the thin film member and the electrostatic latent image support member, thus resulting in production of thin spots or skipped spots in an image.

SUMMARY OF THE INVENTION

Accordingly, an essential object of the present invention is to provide a developing device which eliminates a defective image having thin spots or skipped spots.

The present inventors preliminarily confirmed from the following experiments that attractive force mutually act on each other between a developing sleeve and an electrostatic latent image support member through formation of alternating electric field. Initially, the present inventors conducted simple experiments on electrostatic adsorption by using an experimental device shown in FIG. 1. In the experimental device, a roller A made of aluminum and having a diameter of 25 mm is employed as an electrode, while a plate B made of phosphor bronze and having a width of 18 mm, a length of 212 mm and a thickness of about 0.1 mm is supported at its one end portion. A free end of the plate B confronts the roller A so as to be spaced a clearance C of about 3 mm from the roller A. Amount of electric current due to presence and absence of voltage (DC and/or AC) applied between the roller A and the plate B is monitored by a picoammeter D and its wave form is recorded by a recorder.

(1) At the time of application of DC voltage VD

Regardless of whether or not the DC voltage VD is applied, amount of electric current is zero without any change. In visual observation, state of the plate B is unchanged. On the other hand, when the DC voltage VD of 500 V is applied, electric current of about 28 $\mu$A flows as shown in FIG. 2. At this time, the plate B is adsorbed by the roller A. Namely, this state is produced by supremacy of electrostatic attractive force over stiffness of the plate B.

(2) At the time of application of DC voltage VD and AC voltage VA

By applying both the DC voltage VA of 400 V and the AC voltage VA of 800 V (peak-to-peak value), dependence of wave form of electric current on frequency has been examined. As a result, when a low frequency of several to several ten Hz is set, wave form of electric current changed according to frequency as shown in FIG. 3. It was visually confirmed that the plate B is brought into and out of contact with the roller A.

When a high frequency of several hundred Hz to several hundred KHz is set, it was visually confirmed that the plate B is adsorbed to the roll A. At this time, wave form changes as shown in FIGS. 4*a* and 4*b*.

When a ultrahigh frequency of several MHz or more is set, the plate B is spaced away from the roll A without any change. At this time, amount of electric current is zero. This is naturally because electrostatic attractive force is smaller than bending rigidity of the plate B due probably to the fact that charging period determined by time constant $\tau$ of the electric circuit becomes sufficiently longer than a half of a period determined by the set frequency.

Meanwhile, the obtained wave form of electric current corresponds to wave form of applied voltage. In view of adsorptive stability of the plate B, it is considered desirable that applied voltage has a square wave.

As described above, it was confirmed that electrostatic attractive force acts not only at the time of application of the DC voltage but at the time of application of both the DC voltage and the AC voltage.

Then, in a printer provided with a photosensitive drum 100 and a developing device 1 held in contact with the photosensitive drum 100 as shown in FIG. 5, the present inventors examined electrostatic attractive force between the photosensitive drum 100 and the developing device 1. In FIG. 5, the developing device 1 is provided at one side of the photosensitive drum 100 driven for its rotation in the direction of the arrow a. In the developing device 1, a developing tank 2 is constituted by a frame 3 for covering a bottom portion and a rear portion of the developing device 1, a pair of side plates 4 (FIG. 6), a cover 5 and a support 6 attached to a front portion of the cover 5.

A drive roller 10 is obtained either by forming electrically conductive material such as aluminum, stainless steel or the like into a cylindrical shape or by providing an electrically conductive elastic member such as nitrile rubber, silicone rubber, styrene rubber, butadiene rubber or the like on an outer periphery of a metallic roller. A developing bias voltage VX is applied to the drive roller 10.

A thin film member (developing sleeve) 11 is of a cylindrical shape having a peripheral length slightly larger than an outer peripheral length of the drive roller 10 so as to be fitted around the drive roller 10. The developing sleeve 11 is formed, for example, by one of (1) a resinous sheet made of soft resin such as polycarbonate resin, nylon resin, fluoroplastic, etc., (2) a sheet in which carbon, metal powder, various fillers or the like is added to the above soft resin, (3) a metallic thin film made of nickel, stainless steel, aluminum, etc. and (4) a sheet in which the resinous sheet (1) and the metallic thin film (3) are laminated on each other. If specific resistance of the developing sleeve 11 is excessively large, the developing bias voltage VX is applied to the drive roller 10 less effectively, so that improper development is likely to take place. Therefore, it is desirable that specific resistance of the developing sleeve 11 be $10^{11}$ Ω·cm or less. Various commercially available fillers such as calcium carbonate, magnesium silicate, etc. may be employed as the above filler to be added. Meanwhile, two kinds of fillers different in particle diameter may also be employed such that stiffness of the developing sleeve 11 is increased by the filler having the small particle diameter. Meanwhile, the filler having the large particle diameter not only stabilizes transport of developer but- imparts proper surface hardness and indentations to the surface of the developing sleeve 11 so as to prevent fusion bonding or adherence of the developer to a blade for regulating the developer, which will be described later.

As shown in FIG. 6, the drive roller 10 around which the developing sleeve 11 is fitted is rotatably supported by a shaft 10*a* inserted through a bearing hole 7 of each of the side walls 4 and is coupled with a drive source (not shown). Each of opposite end portions of the drive roller 10 is disposed in a recess 8 formed in each of the side walls 4. An elastic guide pad 9 is inserted between the recess 8 and the developing sleeve 11 fitted around the drive roller 10 so as to bring the developing sleeve 11 into close contact with an outer peripheral surface of the drive roller 10. The guide pad 9 may be made of foamed polyurethane, rubber, etc. or may be foamed by a film of polyethylene, nylon or Teflon such that the film is brought into contact with the developing sleeve 11.

The recess 8 opens to a front face 4*a* of each of the side plates 4 at one side of the recess 8 adjacent to the photosensitive drum 100. At the front face 4*a*, the guide pad 9 is cut out. Therefore, the developing sleeve 11 is brought into close contact with the outer peripheral surface of the drive roller 10 at an area where the developing sleeve 11 is held in contact with the guide pad 9. On the other hand, at the remaining area, namely, at an area confronting the front face 4*a* of each of the side plates 4, an excess portion of the developing sleeve 11 having the peripheral length slightly larger than the outer peripheral length of the drive roller 10 appears in concentrated manner. Thus, a space portion or a sag portion S is formed between the developing sleeve 11 and the drive roller 10. A portion of an outer peripheral surface of the developing sleeve 11, which covers the space portion S, is Brought into contact with the outer peripheral surface of the photosensitive drum 100 so as to form a developing region X.

In the developing tank 2, a blade 12 is brought into contact with the developing sleeve 11 so as to not only electrically charge the developer but form a developer layer of a predetermined thickness on the developing sleeve 11. Meanwhile, a rotary agitator 13 for supplying the developer to the developing sleeve 11 while agitating the developer is provided rearwards of the developing sleeve 11.

In FIGS. 7*a* and 7*b*, states of contact between the photosensitive drum 100 and the developing sleeve 11 in operation are monitored from above in the printer of FIG. 5. In FIG. 7*a*, DC voltage is employed as the developing bias voltage VX. Meanwhile, in FIG. 7*b*, both DC voltage and AC voltage are employed as the developing bias voltage VX. As a result, in FIG. 7*a*, a clearance (noncontact state) leading to thin spots or skipped spots of an image is produced between the photosensitive drum 100 and the developing sleeve 11. On the other hand, in FIG. 7*b*, such clearance is not produced at all. This can be explained as follows from the results of the above mentioned simple experiment on electrostatic attractive action. In FIGS. 7*a* and 7*b*, DC potential difference between the photosensitive drum 100 and the developing sleeve 11 is set at about 50 V. In addition, in FIG. 7*b*, a peak-to-peak AC voltage of 600 V having a frequency of 200 Hz is applied. As a result, in FIG. 7*a*, an electrostatic attractive force corresponding to the potential difference of about 50 V is applied between the photosensitive drum 100 and the developing sleeve 11. Meanwhile, in FIG. 7*b*, an electrostatic attractive force corresponding to a maximum potential difference of 350 V is applied between the photosensitive drum 100 and the developing sleeve 11. A force applied to a unit area between the photosensitive drum 100 and the developing sleeve 11 is expressed by the equation.

$$f = ED \cdot A/2 = CV^2/2AL \ (N/m^2)$$

where:

E=field strength, D=dielectric flux density, C=electrostatic capacity, V=potential difference, A=area of confrontation between the photosensitive drum 100 and the developing sleeve 11, and L=distance between the photosensitive drum 100 and the developing sleeve 11.

From the above equation, the electrostatic attractive force is proportional to square of the potential difference V. Hence, naturally, the electrostatic attractive force in FIG. 7*b* becomes larger than that of FIG. 7*a*.

In the above example, effect of application of the AC voltage in addition to the DC voltage is described when the potential difference between the photosensitive drum 100 and the developing sleeve 11 is as low as about 50 V, namely, the image is of halftone. However, also in the case where the DC potential difference is as high as about 200 V, namely, a solid image is formed, the same effect can be achieved according to operational conditions.

As described above, it will be understood that proper contact between the electrostatic latent image support member and the developing sleeve can be secured by forming alternating electric field therebetween.

In accordance with the developing device according to the present invention, since alternating electric field is produced such that an attractive force for stably bringing the electrostatic latent image support member and the developing sleeve into contact with each other is applied between the electrostatic latent image support member and the developing sleeve to be in contact with the electrostatic latent image support member, the electrostatic latent image support member and the developing sleeve are brought into light contact with each other stably and uniformly.

BRIEF DESCRIPTION OF THE DRAWINGS

This object and features of the present invention will become apparent from the following description taken in conjunction with the preferred embodiments thereof with reference to the accompanying drawings, in which.

Before the description of the present invention proceeds, it is to be noted that like parts are designated by like reference numerals throughout several views of the accompanying drawings.

DETAILED DESCRIPTION OF THE INVENTION

Figure 8:
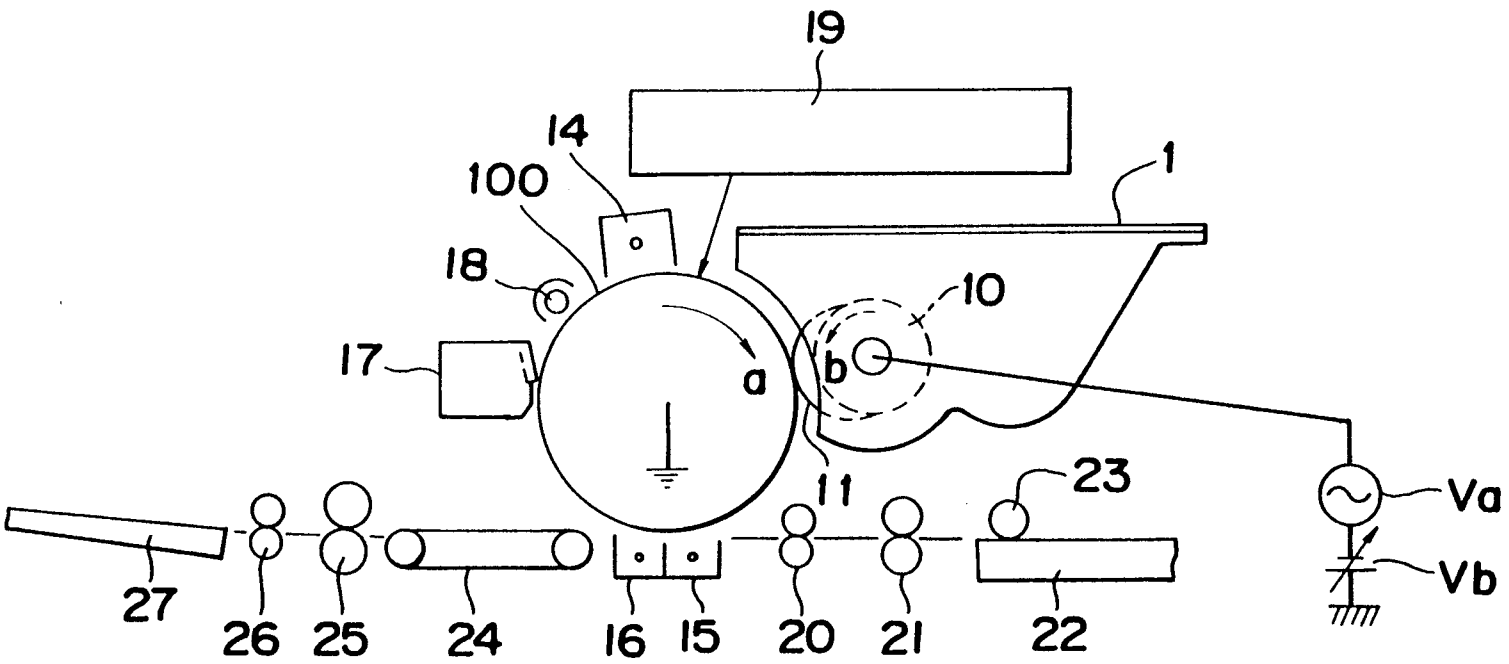
FIG. 8 is a schematic view of a printer incorporating a developing device according to a first embodiment of the present invention.

Referring now the drawings, there is shown in FIG. 8, a printer in which a developing device 1 according to a first embodiment of the present invention is incorporated. The developing device 1 has basic structure identical with that of the developing device 1 of FIG. 5. The printer includes a photosensitive drum 100 shown in FIG. 5. A corona charger 14, the developing device 1, a transfer charger 15, a charge eraser 16, a cleaner 17 and an eraser lamp 18 are sequentially provided around the photosensitive drum 100. An optical system 19 employing a semiconductor laser is provided above the photosensitive drum 100. A pair of timing rollers 20, a pair of intermediate transport rollers 21 and a paper feeding cassette 23 for accommodating a stack of transfer paper sheets are sequentially provided upstream of the transfer charger 15. A paper feeding roller 23 is provided for the paper feeding cassette 22. Meanwhile, a transport belt 24 for transporting the transfer paper sheet, a pair of fixing rollers 25, a pair of outlet rollers 26 and a copy receiving tray 27 are sequentially provided downstream of the charge eraser 16.

Figure 1:
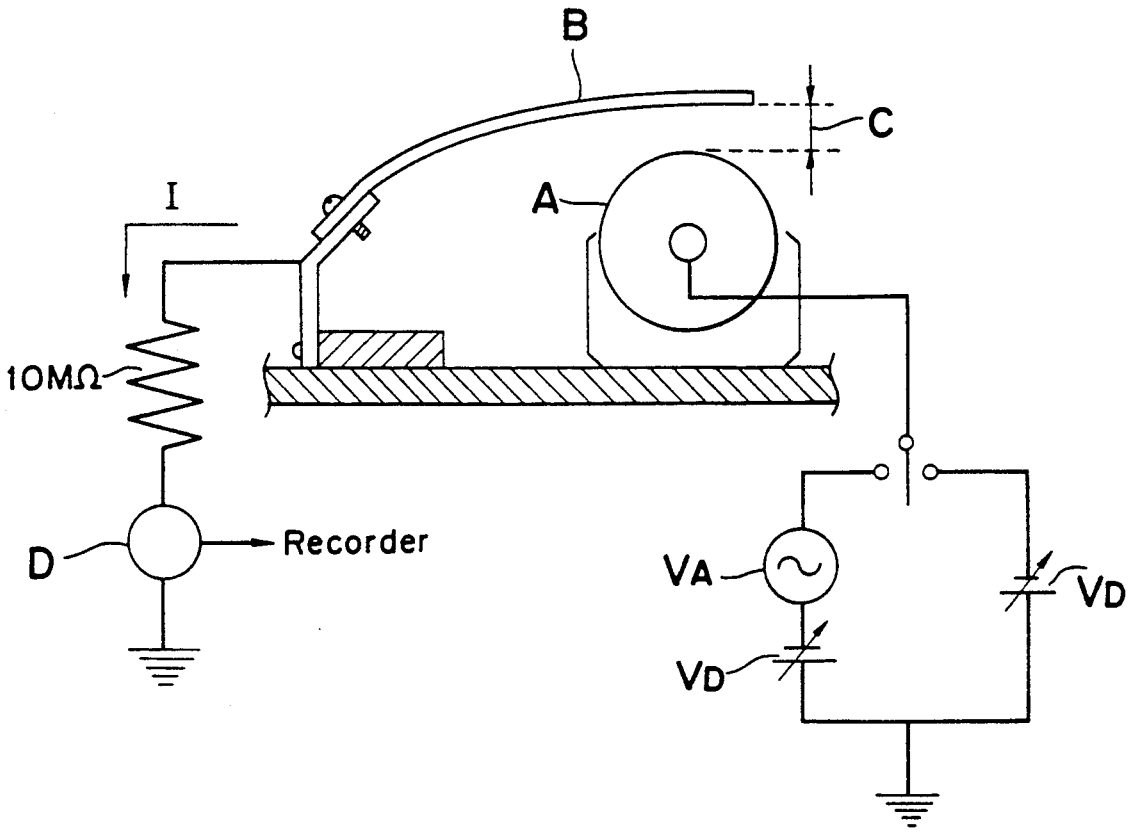
FIG. 1 is a schematic view of an experimental device used in experiments on electrostatic adsorption by the present inventors (already referred to)
Figure 2:
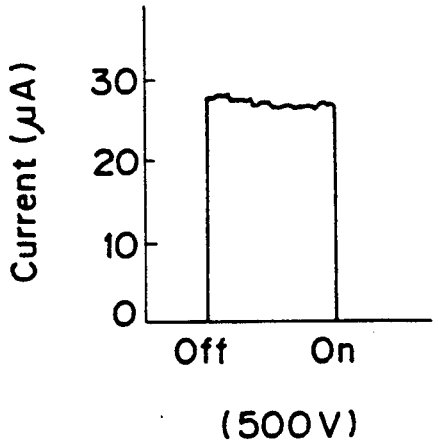
FIG. 2 is a graph showing current wave form obtained in the experiments of FIG. 1 at the time of application of a DC voltage of 500 V (already referred to)
Figure 3:
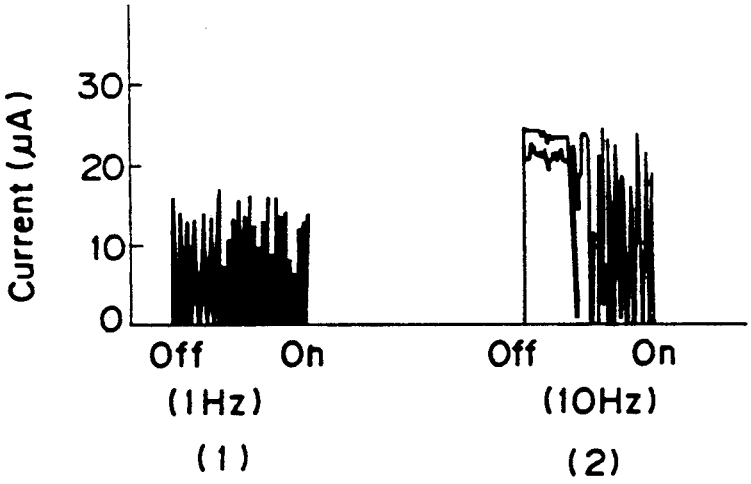
FIG. 3 is a graph showing current wave form obtained in the experiments of FIG. 1 at the time of application of both a low-frequency AC voltage and a DC voltage (already referred to)
Figure 4A:
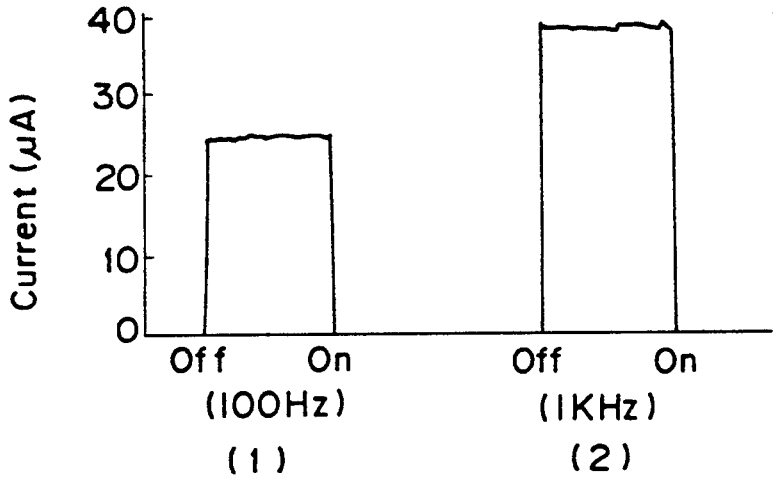
FIGS. 4*a* and 4*b* are graphs showing current wave form obtained in the experiments of FIG. 1 at the time of application of both a high-frequency AC voltage and the DC voltage (already referred to)
Figure 4B:
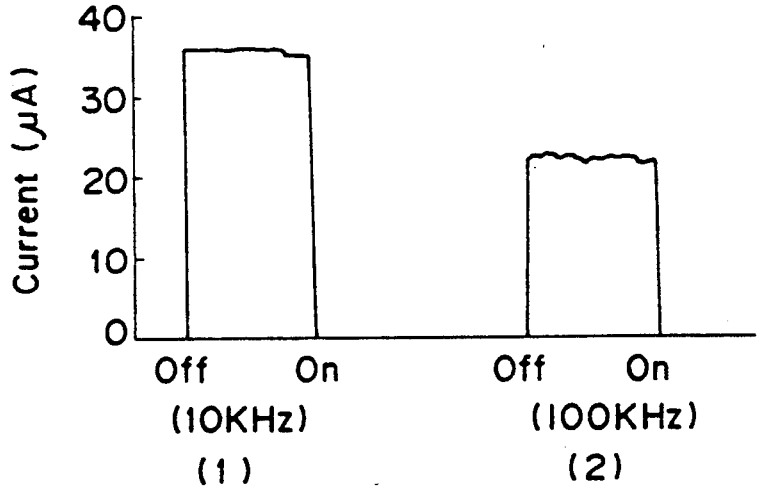
Figure 5:
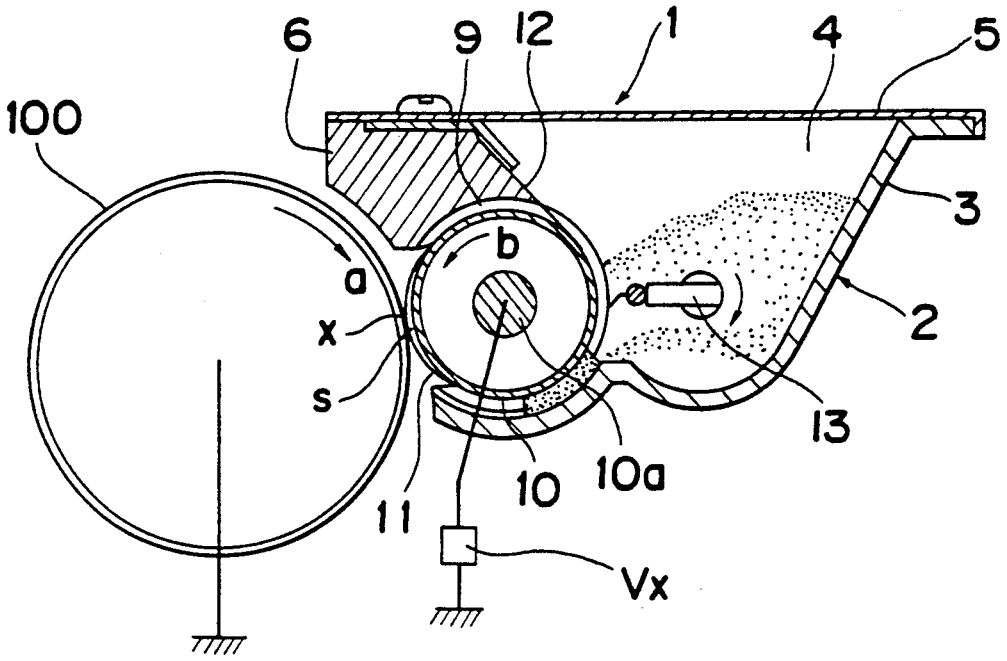
FIG. 5 is a sectional view of a photosensitive drum and a developing device of a printer employed in the experiments of FIG. 1 (already referred to)
Figure 6:
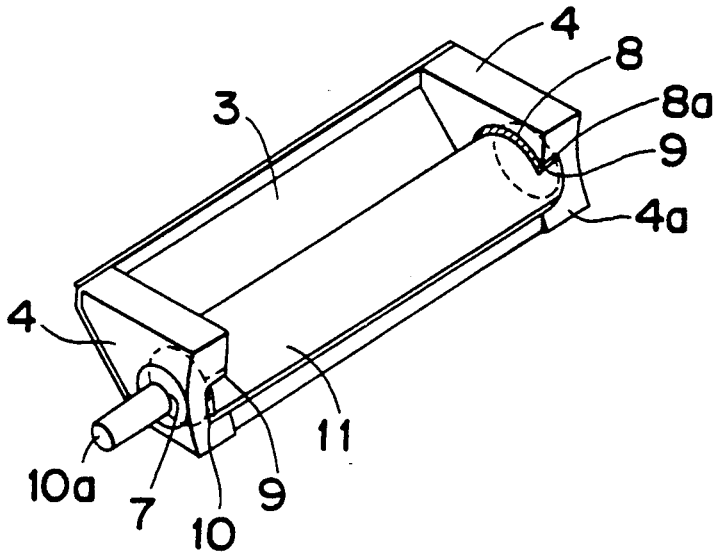
FIG. 6 is a perspective view of the developing device of FIG. 5 (already referred to)
Figure 7A:
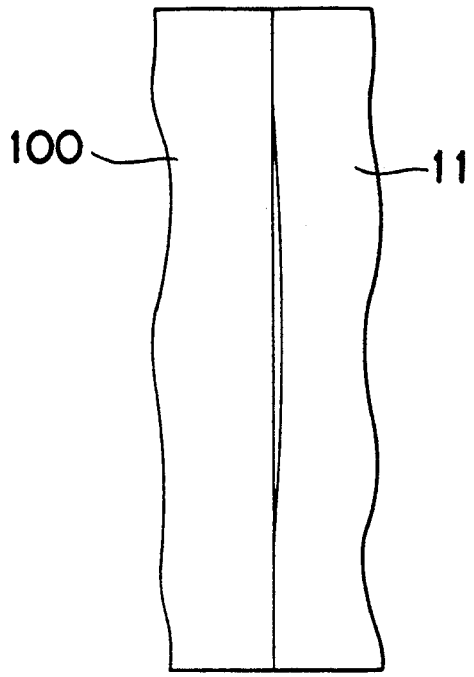
FIGS. 7*a* and 7*b* are top plan views showing states between the photosensitive drum and a developing sleeve in the printer of FIG. 5 at the time of application of only a DC voltage and at the time of application of both an AC voltage and the DC voltage, respectively (already referred to)
Figure 7B:
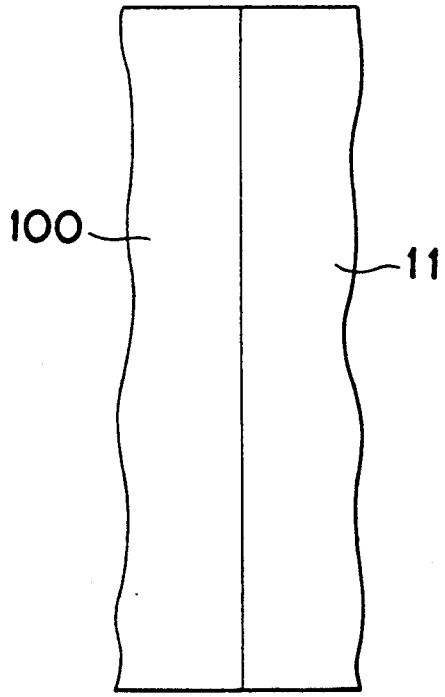

The photosensitive drum 100 is an organic photoconductor and has an outside diameter of 30 mm. The photosensitive drum 100 is rotated in the direction of the arrow a at a peripheral speed of 3.5 cm/sec. A drive roller 10 of the developing device 1 is made of foamed silicone and has an outside diameter of 23.75 mm. The drive roller 10 is rotated in the direction of the arrow b. Referring to FIG. 5, a developing sleeve 11 has an outside diameter of 25 mm and is rotated in the direction of the arrow b by a frictional force generated between the drive roller 10 and the developing sleeve 11 in response to rotation of the drive roller 10. A peripheral speed of the developing sleeve 11 is 1.4 cm/sec., i.e. 40% of that of the photosensitive drum 100. As shown in FIG. 8, voltages from both an AC power source Va and a DC power source Vb are adapted to be applied to the developing sleeve 11 through the drive roller 10.

The voltage of the DC power source Vb is variable, while the voltage of the AC power source Va has a peak-to-peak value of 600 V of 200 Hz in frequency. An initial surface potential of the photosensitive drum 100 imparted by the corona charger 14 is about −600 V. Meanwhile, a potential Vi of an image exposure portion of the photosensitive drum 100 imparted by the optical system 19 is −50 V. Monocomponent developer composed of non-magnetic toner charged to negative polarity is contained in the developing tank 2.

In this printer, the surface of the photosensitive drum 100 is electrically charged uniformly by the corona charger 14. An image is exposed at the charged area of the surface of the photosensitive drum 100 from the optical system 19 such that an electrostatic latent image is formed at the charged area. The electrostatic latent image is inversely developed into a toner image by the developing device 1 and the toner image proceeds to a transfer region confronting the transfer charger 15. On the other, one transfer paper sheet is drawn out of the stack of the transfer paper sheets in the paper feeding cassette 22 by the paper feeding roller 23 and is fed to the timing rollers 20 through the intermediate transport rollers 21. At the timing rollers 20, the transfer paper sheet is conveyed to the transfer region synchronously with the toner image on the photosensitive drum 100. At the transfer region, the toner image on the photosensitive drum 100 is transferred onto the transfer paper sheet by action of the transfer charger 15. Subsequently, the transfer paper sheet is separated from the photosensitive drum 100 by the charge eraser 16 and is transported, via the transport belt 24, to the fixing rollers 25 where the toner image is fixed on the transfer paper sheet. Thereafter, the transfer paper sheet is finally ejected to the copy receiving tray 27 by the outlet rollers 26.

Hereinbelow, concrete examples in which material, thickness, etc. of the developing sleeve 11 are changed variously are described. In the following concrete examples, length of the developing sleeve 11 in the direction of its rotational axis is 300 mm except for Example 2. In Example 2, length of the developing sleeve 11 is 230 mm, 250 mm, 270 mm and 300 mm.

Figure 9A:
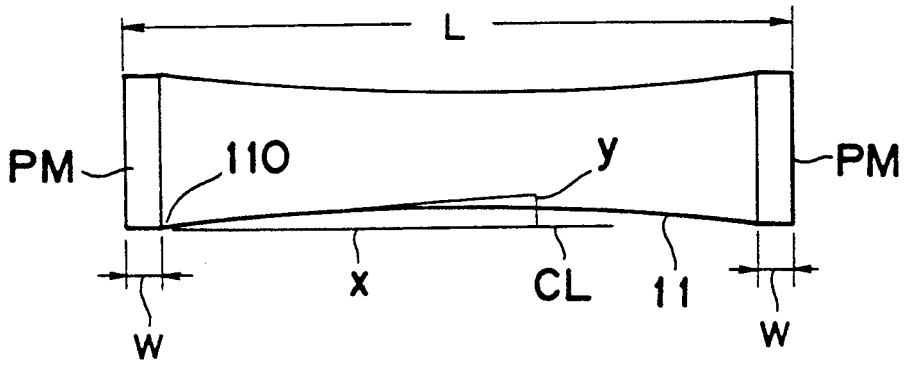
FIGS. 9*a* and 9*b* are a top plan view and a side elevational view explanatory of a method of measuring transverse rigidity index, respectively.
Figure 9B:
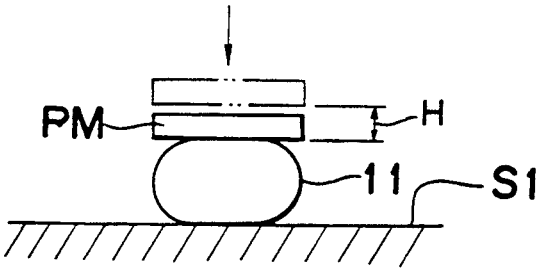

Meanwhile, in the following concrete examples, supposing that as shown in FIGS. 9*a* and 9*b*, the developing sleeve 11 having an outside diameter of 25 mm and a length L of 300 mm is placed on a flat surface S1 and is depressed vertically towards the flat surface S1 through a distance H of 5 mm by applying a press member PM having a width W of 5 mm, to an upper surface of each of opposite end portions of the developing sleeve 11, term "transverse rigidity index" denotes gradient y/x of a face of a portion 110 of the developing sleeve 11 abutting on the press member PM, relative to a centerline CL of the developing sleeve 11. This transverse rigidity index represents property or strength of propagation of deflection of the developing sleeve 11 in the axial direction, which corresponds to material or thickness of the developing sleeve 11. In the printer of FIG. 8, when the opposite end portions of the developing sleeve 11 are depressed against the drive roller 10 by the guide pads 9 and a sag portion S of the developing sleeve 11 is formed at one side of the developing sleeve 11 adjacent to the photosensitive drum 100, the transverse rigidity index indicates to what extent formation of the sag portion S propagates towards an axially central portion of the developing sleeve 11. As the transverse rigidity index becomes smaller, propagation of deflection of the developing sleeve 11 is more excellent and thus, the developing sleeve 11 can be brought into contact with the photosensitive drum 100 more uniformly in the axial direction.

EXAMPLE 1

(1) Material: Amorphous polyamide resin (a-Ny) and crystalline polyamide resin (c-Ny) are blended at a ratio in weight of 6 to 4.

(2) Thickness: 100 $\mu$m (3) Transverse rigidity index: $0.63\times10^{-2}$

EXAMPLE 2

(1) Material: Same as that of Example 1
(2) Thickness: 150 μm
(3) Transverse rigidity index: $0.80\times10^{-2}$ (when length of the developing sleeve 11 is 300 mm)
(4) Sleeve length: 230 mm, 250 mm, 270 mm and 300 mm

EXAMPLE 3

(1) Material: Amorphous polyamide resin (a-Ny) and crystalline polyamide resin (c-Ny) are blended at a ratio in weight of 4 to 6.
(2) Thickness: 100 μm
(3) Transverse rigidity index: $0.68\times10^{-2}$

EXAMPLE 4

(1) Material: 3.2 wt. % of calcicum carbonate having a particle diameter of 10 μm and 4.8 wt. % of calcium carbonate having a particle diameter of 2 μm are added to crystalline polyamide resin (c-Ny) and dispersed.
(2) Thickness: 250 μm
(3) Transverse rigidity index: $1.00\times10^{-2}$

EXAMPLE 5

(1) Material: 4.8 wt. % of calcium carbonate having a particle diameter of 10 μm and 3.2 wt. % of calcium carbonate having a particle diameter of 2 μm are added to crystalline polyamide resin (c-Ny) and dispersed.
(2) Thickness: 250 μm
(3) Transverse rigidity index: $0.85\times10^{-2}$

EXAMPLE 6

(1) Material: 8 wt. % of calcium carbonate having a particle diameter of 2 μm is added to crystalline polyamide resin (c-Ny) and dispersed.
(2) Thickness: 200 μm
(3) Transverse rigidity index: $1.30\times10^{-2}$

EXAMPLE 7

(1) Material: Electroformed belt of nickel
(2) Thickness: 25 μm
(3) Transverse rigidity index: $0.55\times10^{-2}$

EXAMPLE 8

(1) Material: Electroformed belt of nickel
(2) Thickness: 20 μm
(3) Transverse rigidity index: $0.42\times10^{-2}$

TABLE 1

| Ex. | Transverse rigidity index ($\times 10^{-2}$) | Halftone image (DC potential difference of 50 V) | | Solid image (DC potential difference of 200 V) | |
|---|---|---|---|---|---|
| | | AC not used | AC used | AC not used | AC used |
| 1 | 0.63 | P | G | G | G |
| 3 | 0.68 | P | G | G | G |
| 2 | 0.80 | P | G | G | G |
| 5 | 0.85 | P | G | G | G |
| 4 | 1.00 | P | G | G | G |
| 6 | 1.30 | P | G | I | G |
| 7 | 0.55 | P | G | G | G |
| 8 | 0.42 | I | G | G | G |

When voltage of the AC power source Va is set at a peak-to-peak value of 600 V having a frequency of 200 Hz, an initial surface potential of the photosensitive drum 100 due to the corona charger 14 is set at about −600 V and voltage of the DC power source Vb is set at −100 V or −250 V as described above, a latent image on the photosensitive drum 100 has a potential of −50 V by image exposure, while DC potential on the developing sleeve 11 is about 50 V corresponding to an image of halftone and about 200 V corresponding to a solid image. By forming images under these conditions, Table 1 above is obtained.

In Table 1, the heading "AC not used" indicates a case in which only the DC bias voltage is applied, while the heading "AC used" indicates a case in which the AC voltage having the peak-to-peak value of 600 V of 200 Hz in frequency is added to the DC bias voltage. Meanwhile, character "G" denotes good image quality free from skipped spots (especially, central skipped spots) and thin spots in an image, character "P" denotes poor image quality having the above described defective spots and character "I" denotes improper image quality which is not so serious as "P" but is problematical in practical use.

TABLE 2 (1)

| Sleeve length (mm) | Halftone image (DC potential difference of 50 V) | | | |
|---|---|---|---|---|
| | AC not used | | AC used | |
| | Before allowed to stand | After allowed to stand | Before allowed to stand | After allowed to stand |
| 230 | I | I | G | G |
| 250 | P | P | G | G |
| 270 | P | P | G | G |
| 300 | P | P | G | G |

TABLE 2 (2)

| Sleeve length (mm) | Solid image (DC potential difference of 200 V) | | | |
|---|---|---|---|---|
| | AC not used | | AC used | |
| | Before allowed to stand | After allowed to stand | Before allowed to stand | After allowed to stand |
| 230 | G | I | G | G |
| 250 | G | P | G | G |
| 270 | I | P | G | G |
| 300 | P | P | G | G |

Meanwhile, when images are formed in the same manner as in Table 1 by employing the developing sleeve 11 of 230 mm, 250 mm, 270 mm and 300 mm in length, Tables 2(1) and 2(2) above are obtained. In Tables 2(1) and 2(2), the heading "Before allowed to stand" indicates a case in which as soon as the developing sleeve 11 has been brought into contact with the photosensitive drum 100, an image is formed. Meanwhile, the heading "After allowed to stand" indicates a case in which after the developing sleeve 11 and the photosensitive drum 100 in contact with each other have been allowed to stand at 35° C. and at a relative humidity of 85% for about 90 hours, an image is formed.

It is apparent from Table 1 and Tables 2(1) and 2(2) that formation of a defective image having skipped spots or thin spots can be prevented on the following grounds. Namely, when both the DC voltage and the AC voltage are applied to the developing sleeve 11, an alternating electric field is produced at an area of confrontation between the developing sleeve 11 and the photosensitive drum 100 regardless of whether the halftone image or the solid image is formed. Furthermore, the developing sleeve 11 is flexible. Consequently, the developing sleeve 11 is brought into light contact with the surface of the photosensitive drum 100 stably and uniformly in the direction of the rotational axis of the developing sleeve 11.

Figure 10:
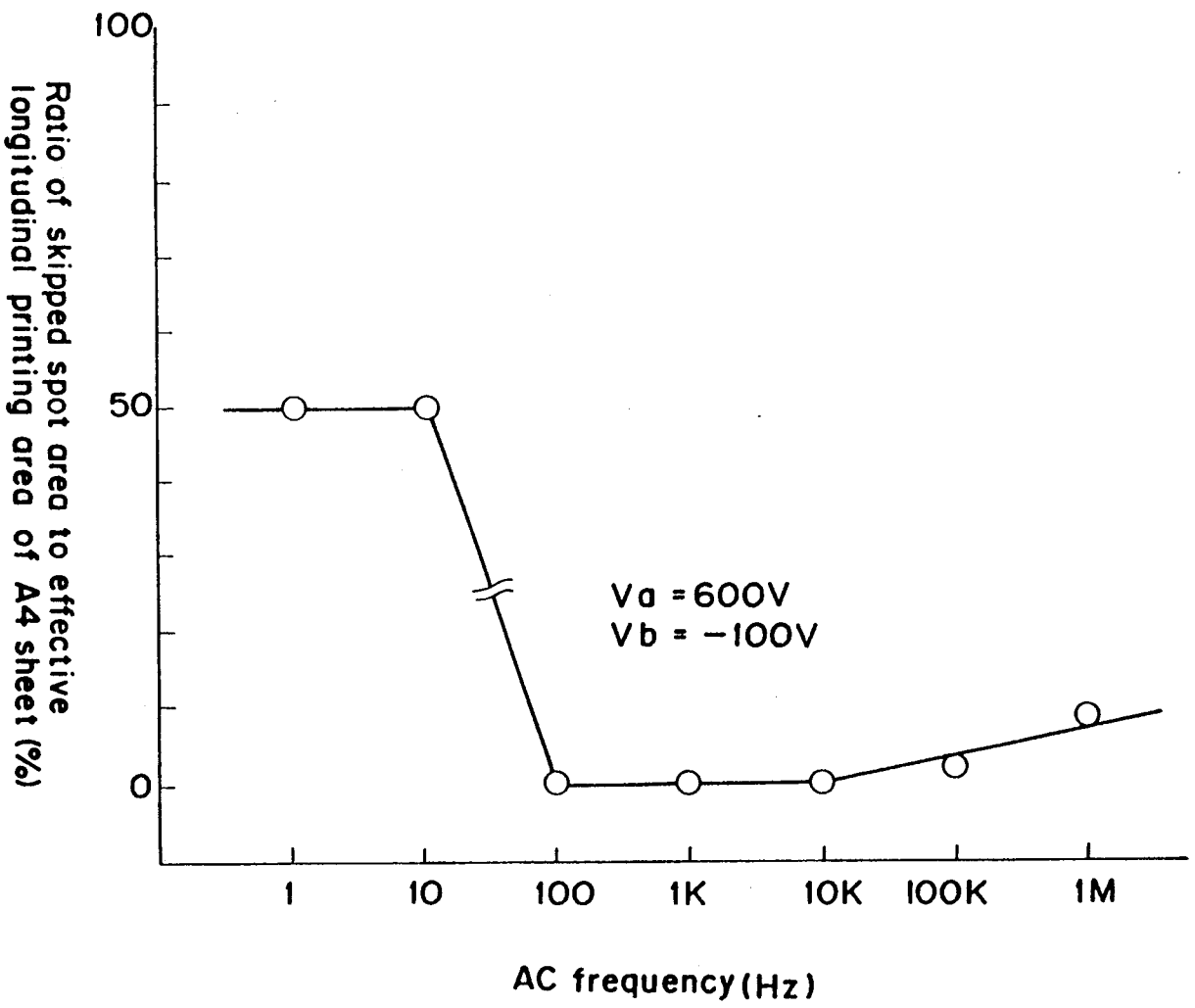
FIG. 10 is a graph showing ratio of skipped spots in an image obtained in the printer of FIG. 8 by changing applied AC frequency.

Meanwhile, FIG. 10 shows results of printing in which images are formed on A4-sized transfer paper sheets by employing the developing sleeve having a length of 250 mm of Example 2, setting voltage of the DC power source Vb at −100 V, setting a peak-to-peak voltage of the AC power source Va at 600 V and changing frequency variously. In FIG. 10, the ordinate represents a ratio of area of skipped spots to effective longitudinal printing area of A4-sized transfer paper sheets in %, while the abscissa represents AC frequency in Hz. It is seen from FIG. 10 that a frequency of 100 Hz to 10 KHZ is proper. If frequency is lower than 100 Hz, pitched AC noises are generated on the print samples. Meanwhile, when frequency exceeds 10 KHz, electrical charging duration becomes larger than a half period, effect of application of the AC voltage is lessened and thus, skipped spots (central skipped spots) are produced.

Figure 11:
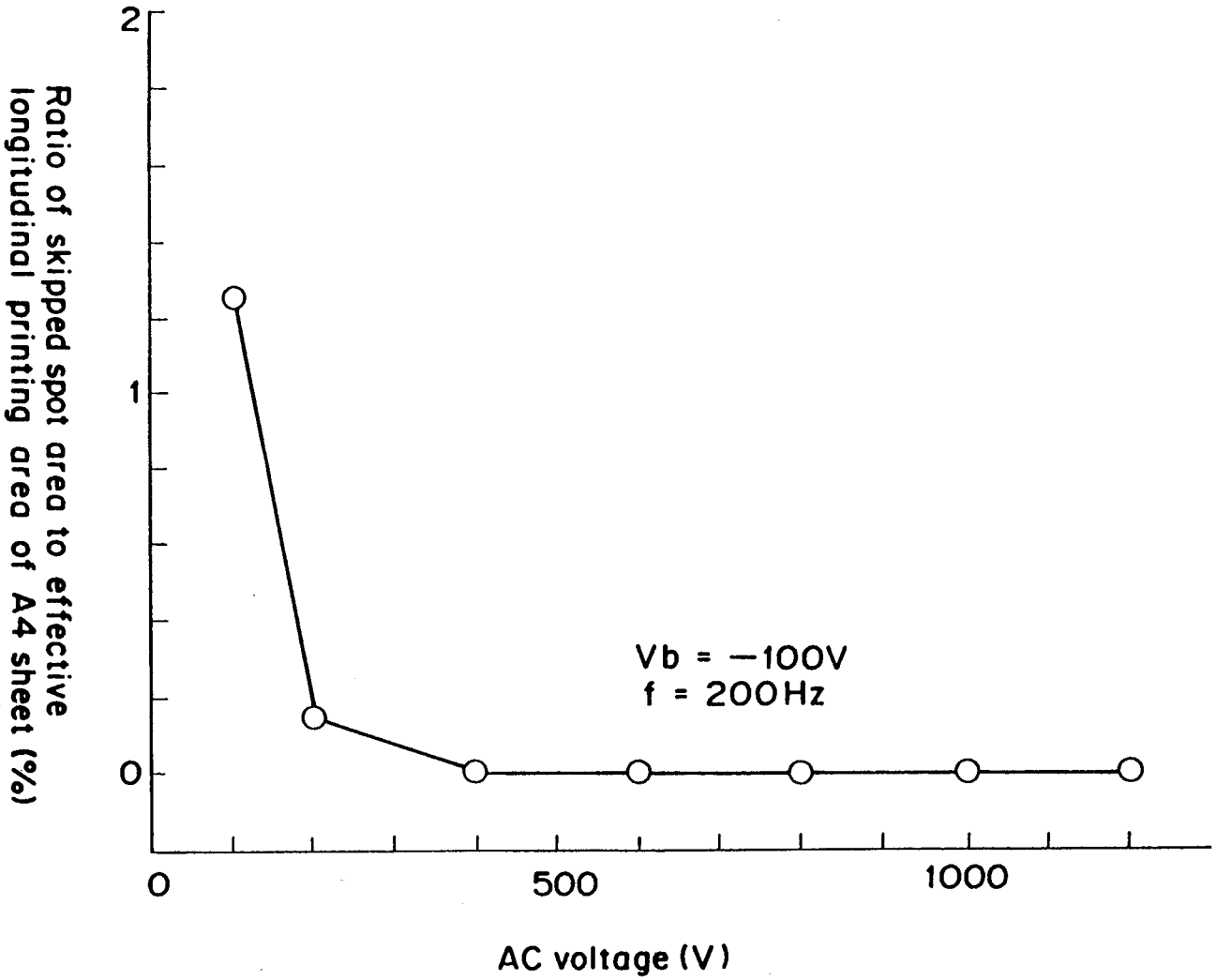
FIG. 11 is a graph showing ratio of skipped spots in an image obtained in the printer of FIG. 8 by changing applied AC voltage.
Figure 12:
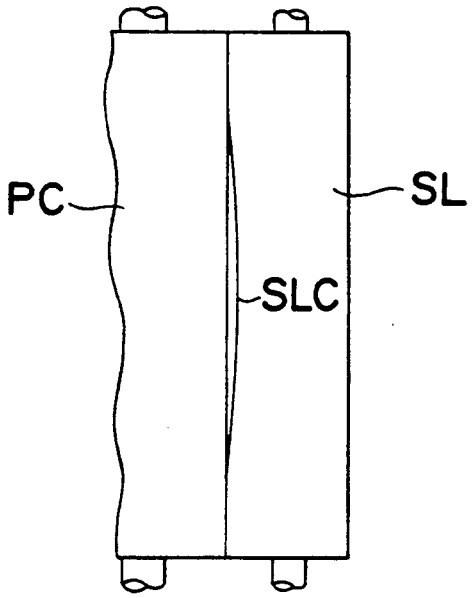
Fig. 12 PRIOR ART
FIG. 12 is a fragmentary view showing a prior art developing device (already referred to)

Furthermore, FIG. 11 shows results of printing in which images are formed on A4-sized transfer paper sheets and ratio of area of skipped spots to effective longitudinal printing area of the A4-sized transfer paper sheets is examined by employing the developing sleeve of FIG. 10, setting voltage of the DC power source Vb at −100 V, setting frequency of the AC power source Va at 200 Hz and changing peak-to-peak voltage of the AC power source Va variously. It will be seen from FIG. 11 that the AC power source Va should have a peak-to-peak voltage of 400–1,000 V desirably. If voltage of the AC power source Va is lower than 400 V, effect of application of the AC voltage is lessened. On the other hand, when voltage of the AC power source Va exceeds 1,000 V, electrostatic contrast in potential between an image forming portion and an image nonforming portion of the photosensitive drum 100 becomes too large and thus, fog is produced in background of an image.

Then, a second embodiment of the present invention is described. The second embodiment relates to an image forming apparatus in which development is performed through contact of a developer support member with an electrostatic latent image support member and at least one of the developer support member and the electrostatic latent image support member has a flexible surface, comprising: an electric field forming means for forming alternating electric field such that an attractive force capable of bringing the developer support member and the electrostatic latent image support member into contact with each other is applied between the developer support member and the electrostatic latent image support member; and a changeover means for changing over the electric field forming means to a connective state or a nonconnective state.

Figure 13:
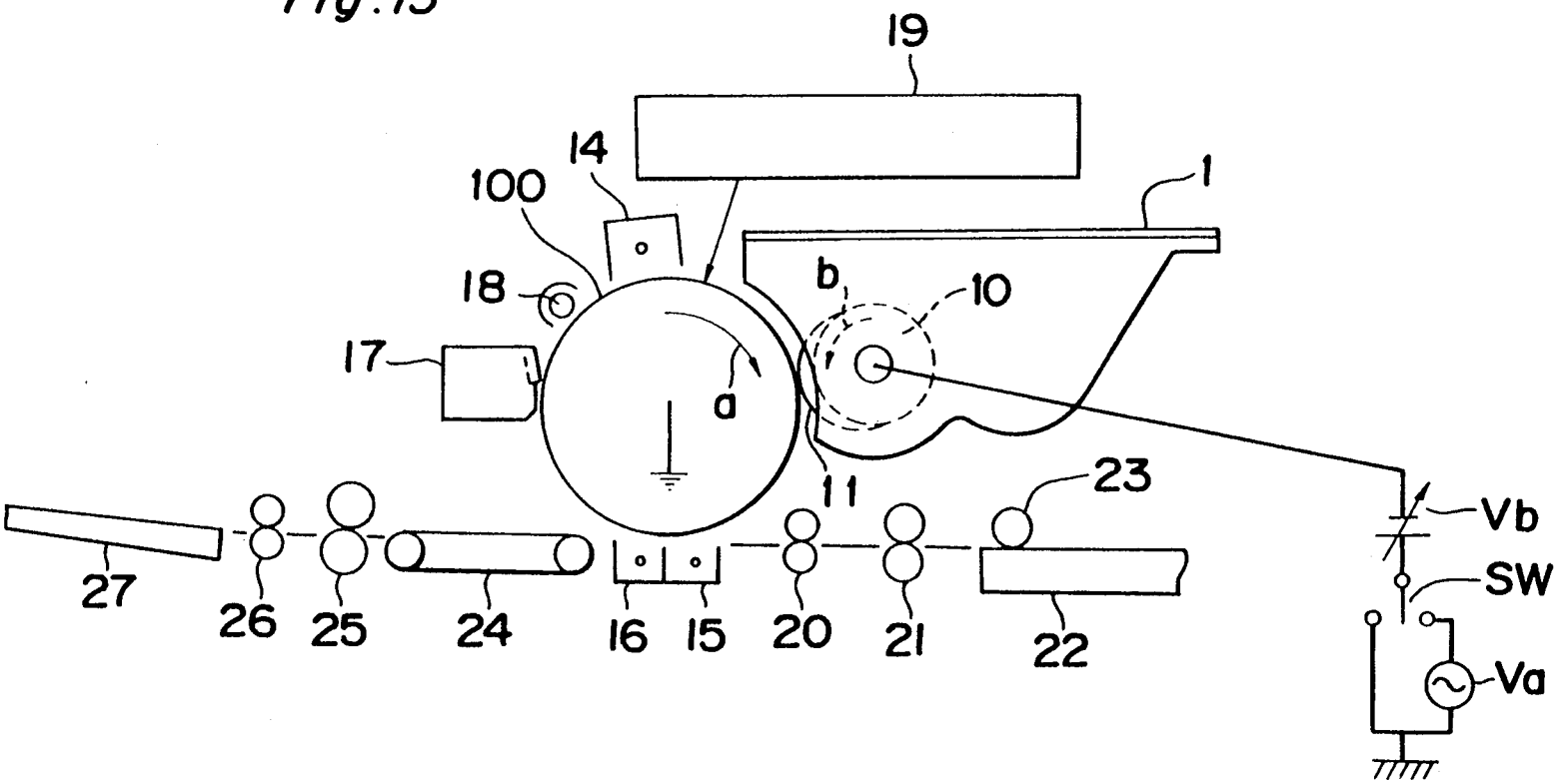
FIG. 13 is a schematic view of a printer incorporating a developing device according to a second embodiment of the present invention.

In the image forming apparatus according to the second embodiment of the present invention, when the electric field forming means is used in the nonconnective state through changeover by the changeover means, a clear image of high contrast can be obtained by hard development suitable for formation of a line image. Meanwhile, when the electric field forming means is used in the connective state through changeover by the changeover means such that alternating electric field is formed between the electrostatic latent image support member and the developer support member, an image having excellent halftone reproducibility can be formed. FIG. 13 shows the image forming apparatus according to the second embodiment of the present invention. Except for the following points, the printer of FIG. 13 has constructions substantially identical with those of the printer of FIG. 8.

In FIG. 13, the developing sleeve 11 is formed by blending amorphous polyamide resin (a-Ny) and crystalline polyamide resin (c-Ny) such as nylon at a ratio in weight of 6 to 4 and has an electric resistance of about $10^6\ \Omega$. The developing sleeve 11 further has an outside diameter of 25 mm and a thickness of 150 μm. In response to rotation of the drive roller 10, the developing sleeve 11 is rotated in the same direction as the drive roller 10 through frictional force applied therebetween. A peripheral speed of the developing sleeve 11 is 2.5 times that of the photosensitive drum 100.

A developing bias voltage is adapted to be applied to the developing sleeve 11 through the drive roller 10. A bias power source includes an AC power source Va and a DC power source Vb. The AC power source Va can be changed over to a connective state and a nonconnective state by a changeover switch SW.

In image formation, when only the DC power source Vb is connected by the switch SW, a hard image suitable for a line image is formed. Meanwhile, when the AC power source Va and the DC power source Vb are connected by the switch SW, the AC and DC bias voltages are applied to the developing sleeve 11 at an area of the developing sleeve 11 confronting the photosensitive drum 100 so as to produce alternating electric field. In addition, the developing sleeve 11 is flexible. As a result, the developing sleeve 11 is brought into light contact with the surface of the photosensitive drum 100 stably and uniformly in the direction of the rotational axis of the developing sleeve 11 and thus, an image having excellent halftone reproducibility can be obtained.

In the printer of FIG. 13, an initial charging potential of the surface of the photosensitive drum 100 imparted by the corona charger 14 is −600 V and a potential Vi of an image exposure portion of the photosensitive drum imparted by the optical system 19 is set at −50 V. Meanwhile, the AC power source Va is set at a peak-to-peak voltage of 600 V having a frequency of 200 Hz. When voltage of the DC power source Vb is increased by 100 V from −400 V stepwise under the above conditions, DC potential difference $\Delta V = |Vb - Vi|$ (V) and maximum potential difference ΔVmax (V) are calculated as follows.

| Vb (V) | ΔV (Only Vb is used) | ΔVmax (Vb and Va are used) |
|---|---|---|
| −400 | 350 | 650 |
| −300 | 250 | 550 |
| −200 | 150 | 450 |
| −100 | 50 | 350 |
| 0 | 50 | 350 |
| 100 | 150 | 450 |
| 200 | 200 | 550 |

Figure 14:
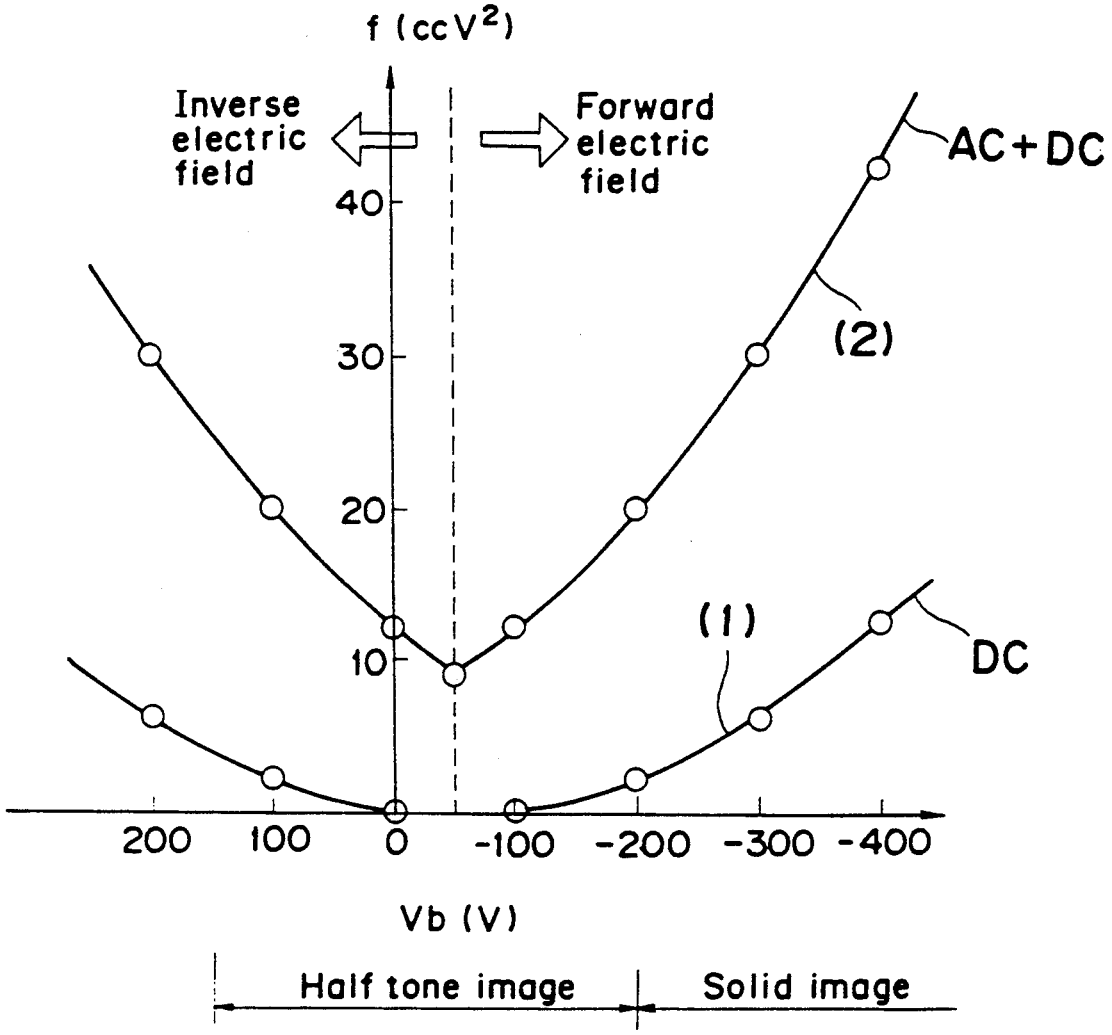
FIG. 14 is a graph showing electrostatic attractive force applied between a photosensitive drum and a developing sleeve in the printer of FIG. 13.

When voltage of the AC power source Vb is changed as described above, namely, potential difference (potential contrast) for developing an electrostatic latent image is changed, the electrostatic attractive force applied between the photosensitive drum 100 and the developing sleeve 11 is obtained from the equation $f=CV^2/2AL$ referred to earlier as shown in FIG. 14. In FIG. 14, the curve (1) represents a case in which only the DC power source Vb is used, while the curve (2) represents a case in which both the AC power source Va and the DC power source Va are used.

As is apparent from FIG. 14, when the AC voltage is applied in addition to the DC voltage, the electrostatic attractive force is increased as a whole. As a result, toner is brought into closer contact with the photosensitive drum 100 and the photosensitive drum 100 and the developing sleeve 11 come closer to each other through the toner, so that effective electric field which exerts influence on displacement of the toner from the developing sleeve 11 to the photosensitive drum 100 is increased.

Figure 15:
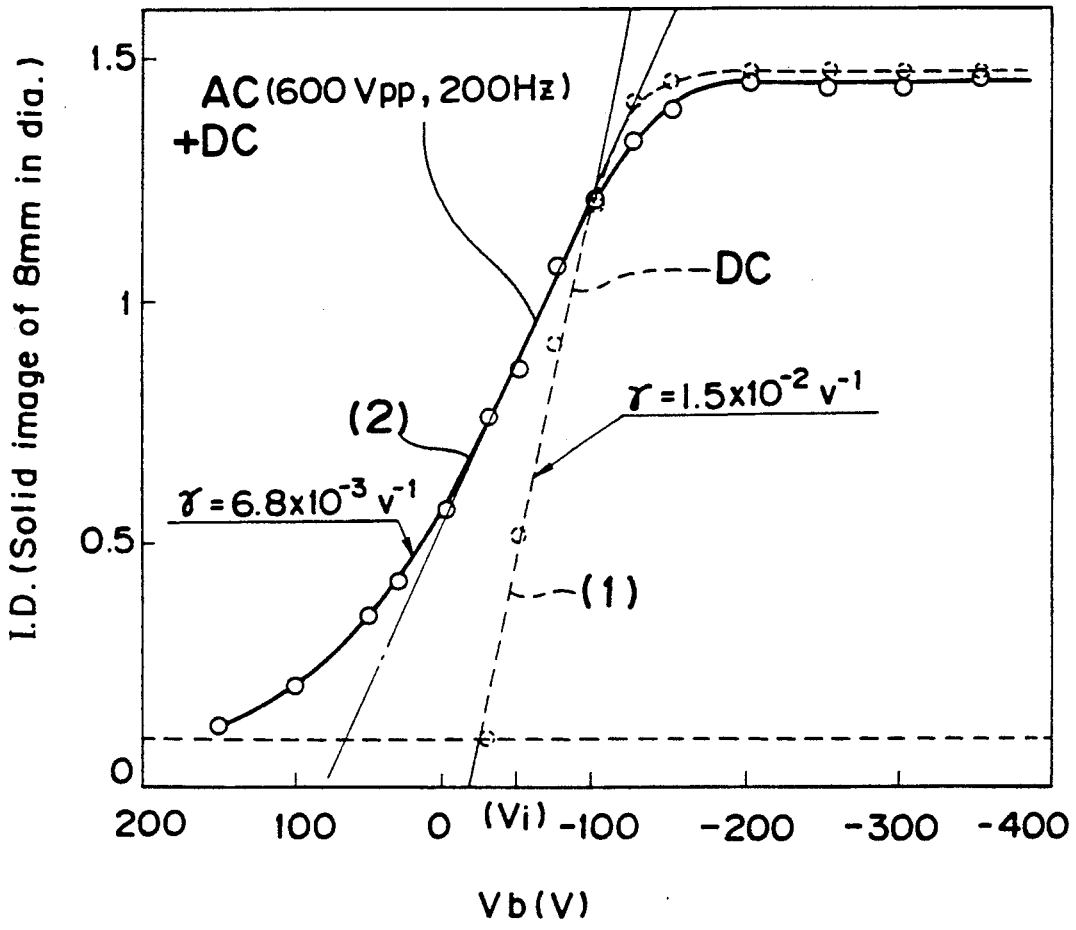
FIG. 15 is a graph showing image density of solid images obtained in the printer of FIG. 13.
Figure 16:
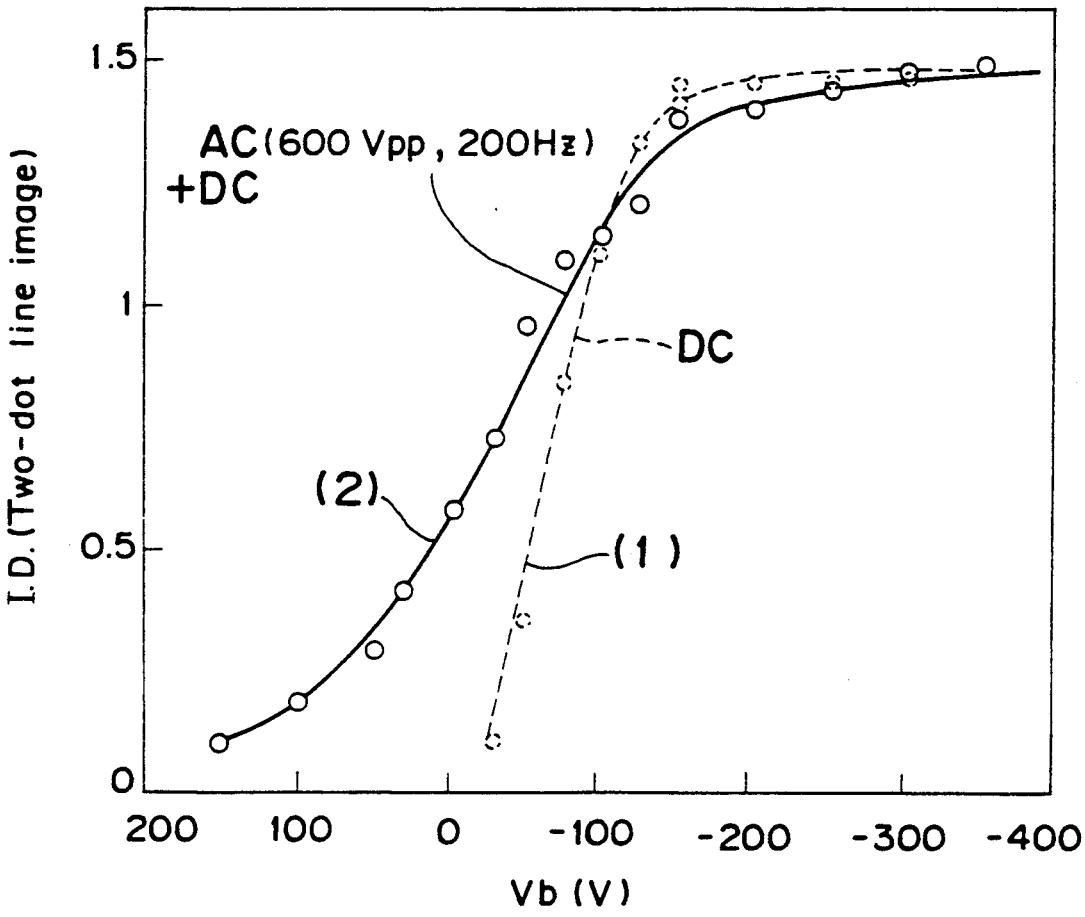
FIG. 16 is a graph showing image density of two-dot line images obtained in the printer of FIG. 13.

When solid images of 8 mm in diameter are formed by changing the DC voltage as described above in the printer of FIG. 13, development characteristic curves ($\gamma$ curves) are obtained as shown in FIG. 15 by measuring image density (I.D.). Meanwhile, when images of two-dot lines are formed likewise, development characteristic curves ($\gamma$ curves) are obtained as shown in FIG. 16. A thin layer of toner on the developing sleeve 11 has an average toner particle diameter of 9.2 $\mu$m, a charged quantity of $-34.2$ $\mu$c/g and a toner amount of 0.543 mg/cm$^2$.

In FIGS. 15 and 16, the broken line (1) represents a case in which only the DC voltage is applied, while the solid line (2) represents a case in which both the AC voltage and the DC voltage are applied. In FIG. 15, gradient ($\gamma$) of a rise portion of the broken line (1) is $1.5\times10^{-2}V^{-1}$, while gradient ($\gamma$) of a rise portion of the solid line (2) is $6.3\times10^{-3}V^{-1}$. Thus, $\gamma$ of the solid line representing application of both the AC voltage and the DC voltage is smaller than that of the broken line (1) representing application of only the DC voltage. As will be seen from FIGS. 15 and 16, image density (I.D.) rises quite rapidly relative to change of DC potential difference (potential contrast) in the case of application of only the DC voltage, thereby resulting in hard developing property.

On the other hand, in the case of application of both the AC voltage and the DC voltage, the curve (2) is substantially the same as the curve (1) when voltage of the DC power source Vb is $-100$ V or less. Meanwhile, when voltage of the DC power source Vb exceeds $-100$ V, the curve (2) is higher than the curve (1). Furthermore, rise of image density of the curve (2) is gentler relative to change of potential contrast than that of the curve (1). Thus, soft developing property, in other words, developing property having excellent halftone reproducibility is obtained possibly for the following reason. Namely, in the case of the halftone image portion, since amount of toner displaced from the developing sleeve 11 to the photosensitive drum 100 is small naturally, the toner is brought into closer contact with the photosensitive drum 100 by formation of alternating electric field as described above, so that effective electric field is increased and thus, image density is increased.

It is seen from FIG. 16 that even if both the AC voltage and the DC voltage are applied in formation of a line image, edge effect is not achieved especially.

In the second embodiment referred to above, reproduction of halftone can be performed in addition to low-voltage development. Meanwhile, it is possible to select image quality of a hard image and a soft image. Meanwhile, the second embodiment is directed to the printer but may also be applied to a copying apparatus or the like. If the printer of the second embodiment is a multi-value printer, such an advantage can be obtained that the AC voltage can be easily selected so as to be not applied in the case of output of a two-value image but be applied in the case of output of a multi-value image.

Hereinbelow, a concrete example of the printer of FIG. 13 is described. In this example, in order to produce the developing sleeve 11, amorphous polyamide resin (a-Ny) and crystalline polyamide resin (c-Ny) are blended at a ratio in weight of 4 to 6 and then, carbon powder is added and dispersed. By adjusting amount of the carbon powder added to the blended resin, electrical conductivity of the developing sleeve 11 is changed from $10^4$ $\Omega$·cm to $10^{12}$ $\Omega$·cm through $10^6$ $\Omega$·cm, $10^8$ $\Omega$·cm, $10^{10}$ $\Omega$·cm and $10^{11}$ $\Omega$·cm.

Figure 17:
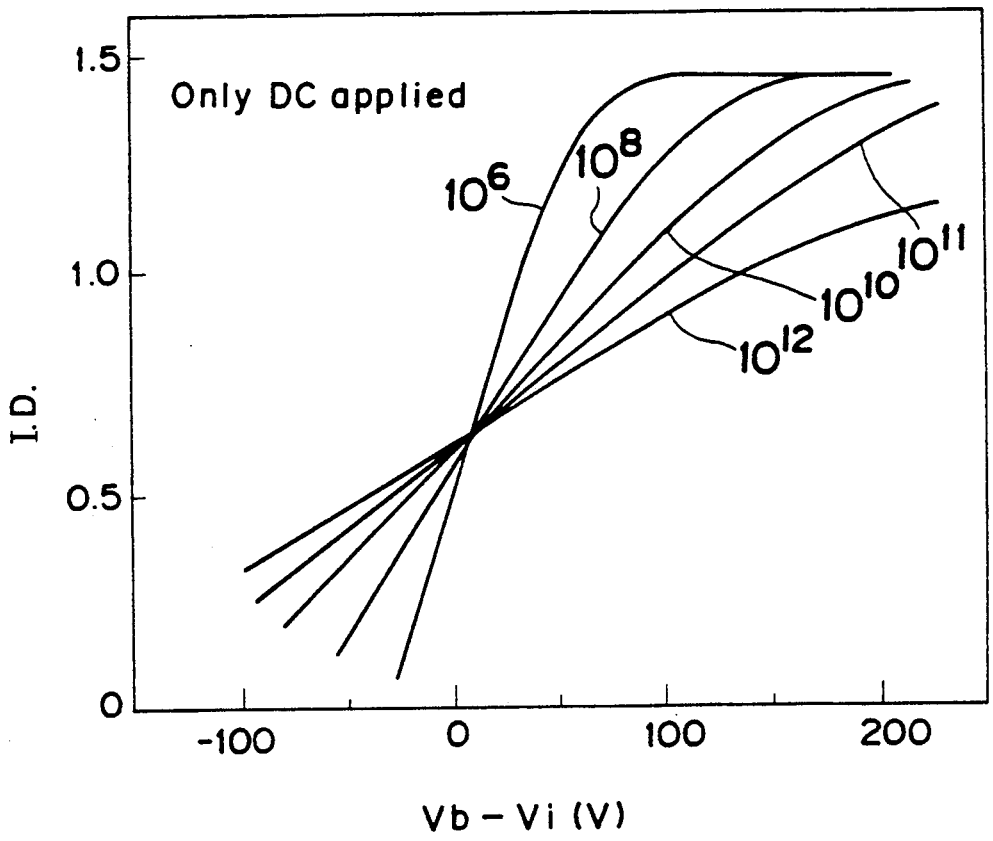
FIG. 17 is a graph showing development characteristic curves obtained in the printer of FIG. 13 when resistance of a developing sleeve is changed and only a DC voltage is applied.
Figure 18:
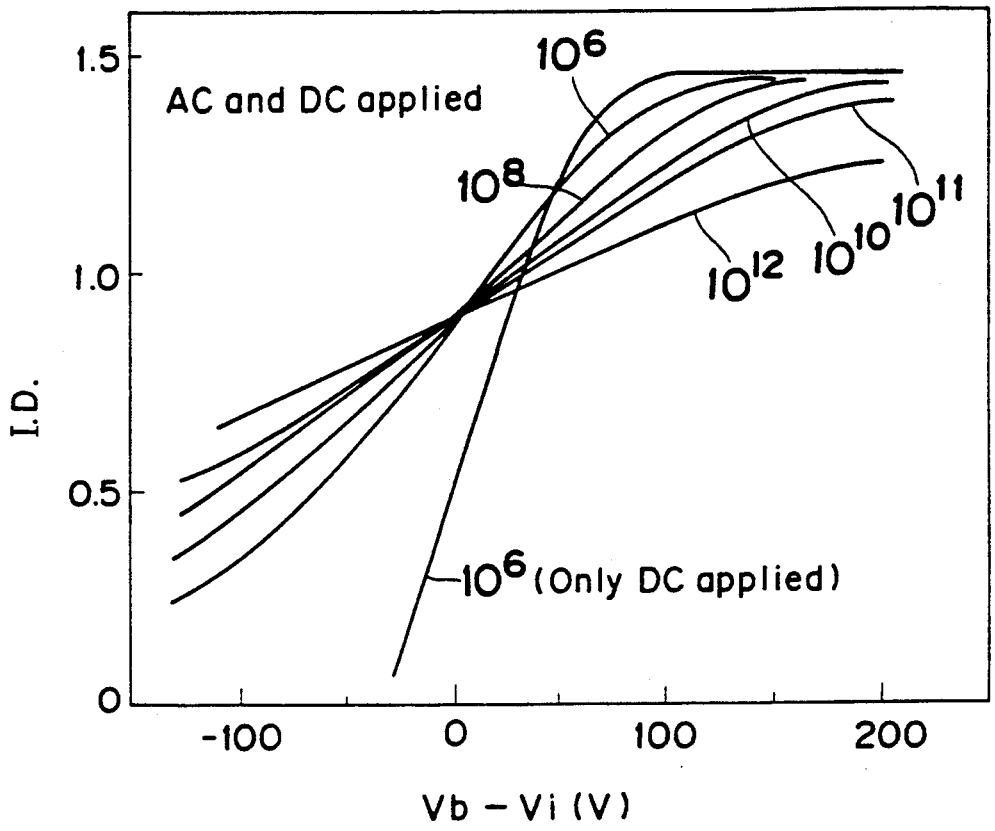
FIG. 18 is a graph showing development characteristic curves obtained in the printer of FIG. 13 when resistance of the developing sleeve is changed and both an AC voltage and a DC voltage are applied.

This developing sleeve 11 of this example is incorporated into the developing device 1 of FIG. 13 and voltage of the AC power source Va is set at a peak-to-peak value of 600 V having a frequency of 200 Hz. Meanwhile, an initial surface potential of the photosensitive drum 100 imparted by the corona charger 14 is set at $-600$ V and the potential Vi of the image exposure portion of the photosensitive drum 100 is set at $-50$ V. Thus, when images are formed by changing voltage of the DC power source Vb variously so as to change potential difference between the photosensitive drum 100 and the developing sleeve 11 from a value suitable for a halftone image to a value suitable for a solid image, development characteristic curve ($\gamma$) is obtained as shown in FIGS. 17 and 18 when only the DC voltage is applied and when both the AC voltage and the DC voltage are applied, respectively. In addition, when a solid image and a halftone image are printed on a transfer paper sheet such that the halftone image abuts on the solid image, drop of $\gamma$ and drop of image density of a neighboring portion, i.e. the halftone image abutting on the solid image are shown in Table 3 below.

Figure 19:
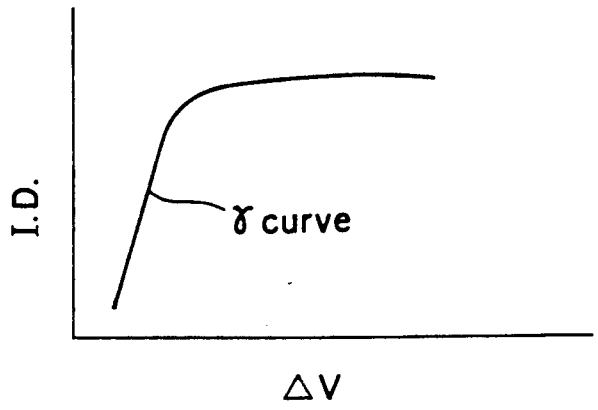
FIG. 19 is a graph explanatory of a development characteristic curve.

In Table 3, $\gamma$ represents gradient of the development characteristic curve ($\gamma$ curve shown in FIG. 19) indicative of relation between potential difference $\Delta V$ for development of an electrostatic latent image between the developing sleeve 11 and the photosensitive drum 100 and image density (I.D.) obtained by the potential difference $\Delta V$, namely, I.D./$\Delta V$. When $\gamma$ is small at low potential difference, it is only possible to obtain a hard image. However, if $\gamma$ is small, a soft image having excellent halftone reproducibility can be obtained.

TABLE 3

| | AC not used | | AC used | |
|---|---|---|---|---|
| Resistance of developing sleeve ($\Omega$.cm) | Drop of $\gamma$ | Drop of image density of neighboring portion | Drop of $\gamma$ | Drop of image density of neighboring portion |
| $10^4$ | C | A | A | A |
| $10^6$ | C | A | A | A |
| $10^8$ | B | A | A | A |
| $10^{10}$ | A | B | A | A |
| $10^{11}$ | A | B | A | A |
| $10^{12}$ | A | C | A | C |

In Table 3, the neighboring portion denotes the halftone image having small toner consumption, which abuts on the solid image having large toner consumption. It is not desirable that image density drops at the neighboring portion. In the column "Drop of $\gamma$" of Table 3, characters A, B and C denote sufficient drop of $\gamma$, insufficient drop of $\gamma$ and no change of $\gamma$, respectively. Meanwhile, in the column "Drop of image density of neighboring portion" of Table 3, characters A, B and C denote no occurrence of its drop, slight occurrence of its drop and occurrence of its drop, respectively.

From FIGS. 17 and 18 and Table 3, it is seen that if both the AC voltage and the DC voltage are applied and the developing sleeve 11 is semiconductive so as to have a specific resistance of about $10^{11}$ Ω·cm or less, drop of γ is sufficient and drop of image density of the neighboring portion does not take place.

When images are formed under the same conditions as Table 3 except for employment of the developing sleeve 11 having a resistance of $10^4$ Ω·cm in the case where potential difference between the photosensitive drum 100 and the developing sleeve 11 is set at about 50 V for a halftone image and about 200 V for a solid image, results shown in Tables 4(1) and 4(2) below are obtained.

In Tables 4(1) and 4(2), headings and symbols have the same meanings as those of Tables 2(1) and 2(2).

It is seen from Tables 4(1) and 4(2) that if both the AC voltage and the DC voltage are applied, alternating electric field is formed at an area of confrontation between the developing sleeve 11 and the photosensitive drum 100 through application of the AC and DC bias voltages to the developing sleeve 11 in the case of formation of the halftone image as well as the solid image not only in the case of "Before allowed to stand" but in the case of "After allowed to stand" and that since the developing sleeve 11 is flexible, the developing sleeve 11 is brought into light contact with the photosensitive drum 100 stably and uniformly in the direction of the rotational axis of the developing sleeve 11 and thus, formation of a defective image having skipped spots such as central skipped spots or thin spots is prevented.

TABLE 4 (1)

| Halftone image (DC potential difference of 50 V) | | | |
|---|---|---|---|
| AC not used | | AC used | |
| Before allowed to stand | After allowed to stand | Before allowed to stand | After allowed to stand |
| P | P | G | G |

TABLE 4 (2)

| Solid image (DC potential difference of 200 V) | | | |
|---|---|---|---|
| AC not used | | AC used | |
| Before allowed to stand | After allowed to stand | Before allowed to stand | After allowed to stand |
| G | P | G | G |

Hereinbelow, a third embodiment of the present invention is described. The third embodiment of the present invention relates to a developing device in which a developing sleeve formed by a flexible thin film and having a peripheral length slightly larger than that of a drive roller is fitted around the drive roller and is brought into pressing contact with the drive roller at one side of the drive roller such that a sag portion of the developing sleeve formed at the other side of the drive roller confronts an electrostatic latent image support member, the developing sleeve being so provided as to be brought into or out of light contact with the electrostatic latent image support member, the developing device comprising: an electric field forming means for forming alternating electric field such that an attractive force for bringing the developing sleeve and the electrostatic latent image support member into close contact with each other is applied between the developing sleeve and the electrostatic latent image support member and a switch means for turning on and off the electric field forming means so as to bring the developing sleeve and the electrostatic latent image support member into and out of contact with each other.

In the developing device according to the third embodiment of the present invention, the alternating electric field can be formed as necessary such that the attractive force capable of stably bringing the electrostatic latent image support member and the developing sleeve into close contact with each other is applied between the electrostatic latent image support member and the developing sleeve. As a result, since the electrostatic latent image support member and the developing sleeve are brought into close contact with each other stably and uniformly, an excellent image can be obtained. On the other hand, if formation of the alternating electric field between the electrostatic latent image support member and the developing sleeve is suspended by actuation of the switch means during stop of the developing device, the developing sleeve is brought out of close contact with the electrostatic latent image support member. Therefore, unrestorable deformation of the development, which occurs if close contact between the developing sleeve and the electrostatic latent image support member is continued, is prevented. Accordingly, even in operation of the developing device after stop of the developing device for a long time, an excellent image free from lateral linear stains or skipped spots can be obtained.

Figure 22:
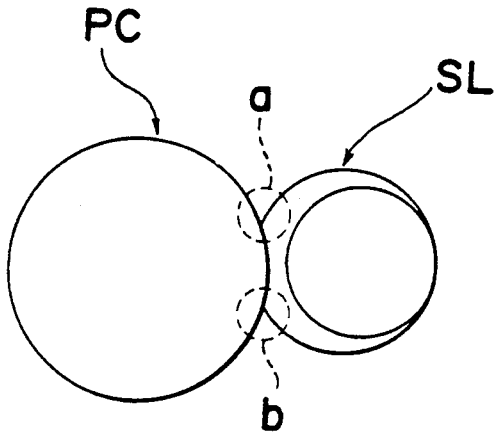
Fig. 22 PRIOR ART
FIG. 22 is a view explanatory of deformation of a developing sleeve of a prior art developing device.

If the developing sleeve is deformed, creases are formed at portions a and b on the developing sleeve in FIG. 22. Hence, when the portions A and B of the developing sleeve 11 come into contact with the electrostatic latent image support member through the next rotation of the developing sleeve, a relatively large contact force is applied to the electrostatic latent image support member. As a result, lateral linear spots or skipped spots are produced on the image.

Figure 20:
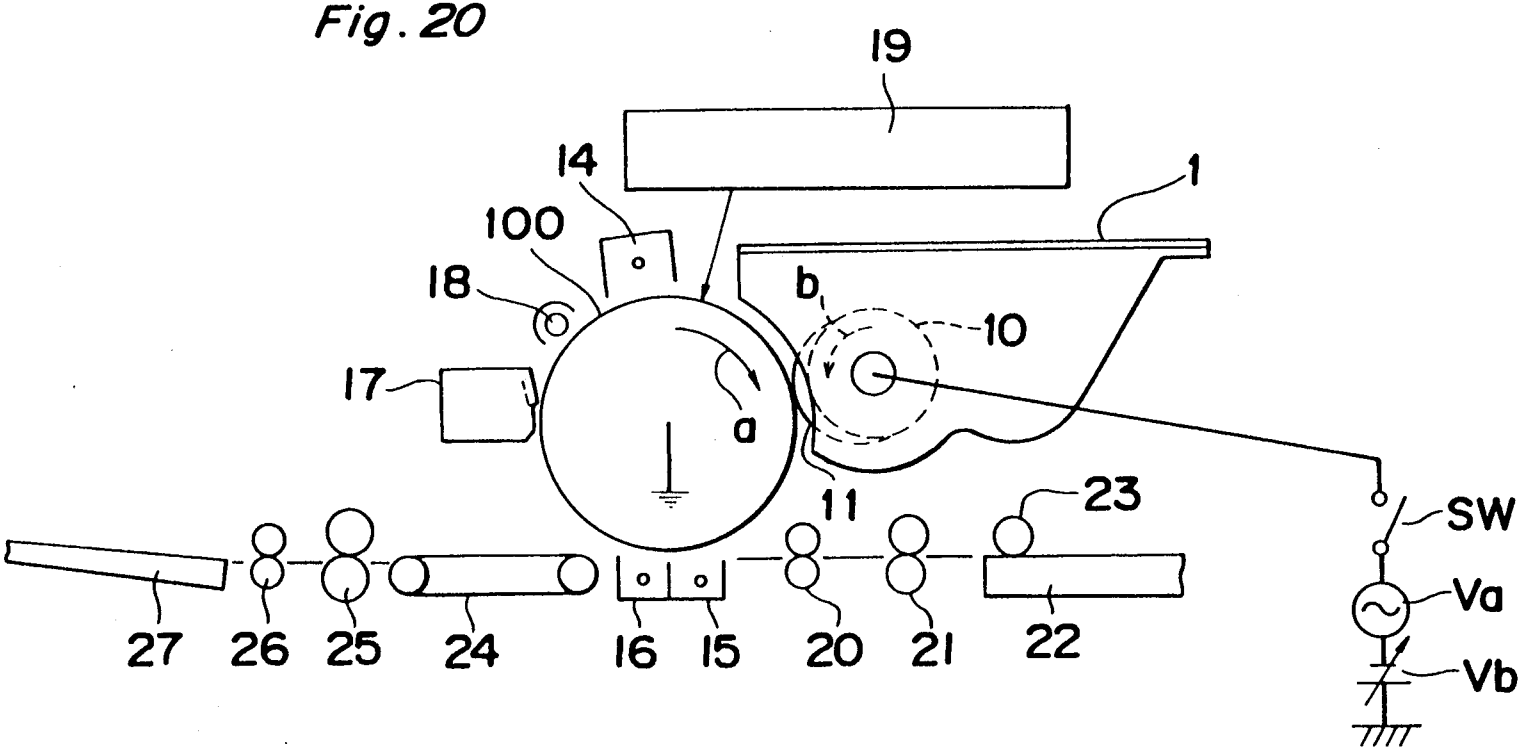
FIG. 20 is a schematic view of a printer incorporating a developing device according to a third embodiment of the present invention.

FIG. 20 shows a printer according to the third embodiment of the present invention. Except for the following points, the printer of FIG. 20 has constructions substantially identical with those of the printer of FIG. 8. In FIG. 20, the developing sleeve 11 is formed by blending amorphous polyamide resin (a-Ny) and crystalline polyamide resin (c-Ny) at a ration in weight of 4 to 6 and has an electric resistance of $10^4$ Ω·cm by adding carbon powder thereto. The developing sleeve 11 has a axial length of 300 mm, an outside diameter of 25 mm and a thickness of 150 μm. In response to rotation of the drive roller 10, the developing sleeve 11 is rotated in the same direction as the drive roller 10 through frictional force applied therebetween. A peripheral speed of the developing sleeve 11 is 2.5 times that of the photosensitive drum 100.

The AC power source Va and the DC power source Vb are adapted to be applied to the developing sleeve 11 by way of the switch SW and the drive roller 10. Voltage of the DC power source Va is variable, while voltage of the AC power source Va has a peak-to-peak value of 600 V of 200 Hz in frequency. Meanwhile, an initial surface potential of the photosensitive drum 100 imparted by the corona charger 14 is about −600 V, while potential of an image exposure portion of the photosensitive drum 100 imparted by the optical system 19 is −50 V.

As concrete examples, a development gap Ds between the surface of the drive roller 10 and the surface of the photosensitive drum 100 at the time when the switch SW is open is set at three values, i.e. about 1 mm, about 1.5 mm and about 2.0 mm. As comparative examples, the gap Ds is set at 0 mm and about 0.5 mm. Thus, when images are formed in the case where the AC voltage and the DC voltage are applied ("AC used") in accordance with the present invention and only the DC voltage is applied ("AC not used") as the comparative examples, results shown in Table 5 below are obtained.

TABLE 5

| | | AC not used | | AC used | |
|---|---|---|---|---|---|
| Ds (mm) | Deformation after allowed to stand | Contact stability | Lateral linear stains, Skipped spots | Contact stability | Lateral linear stains, Skipped spots |
| 0 | C | A | C | A | C |
| +0.5 | B | A | C | A | B |
| +1.0 | B | B | C | A | A |
| +1.5 | A | B | C | A | A |
| +2.0 | A | C | C | A | A |

Figure 21A:
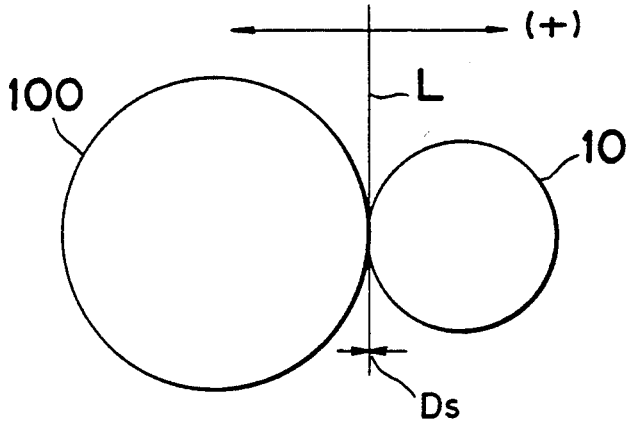
FIGS. 21*a* and 21*b* are views explanatory of development gap in the printer of FIG. 20.
Figure 21B:
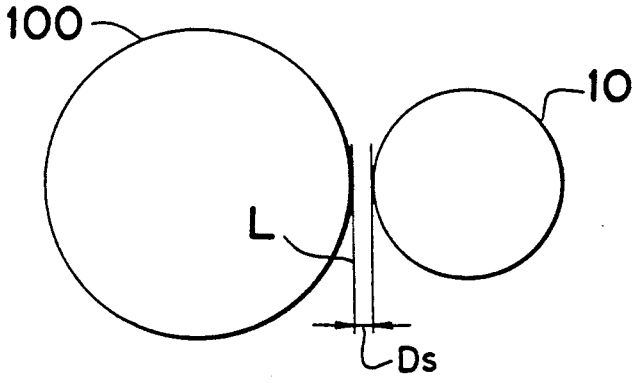

When the drive roller 10 and the photosensitive drum 100 are held in contact with each other such that a common tangent L can be drawn from the drive roller 10 and the photosensitive drum 100 as shown in FIG. 21*a*, the gap Ds is defined as being "0". The drive roller 10 is displaced in a direction remote from -the photosensitive drum 100 as shown in FIG. 21*b*.

Meanwhile, in Table 5, the heading "Deformation after allowed to stand" indicates deformation of the developing sleeve 11 produced after the developing sleeve 11 has been allowed to stand at 35° C. and at a relative humidity of 85% for about 90 hours, while the heading "Contact stability" indicates stability of contact between the developing sleeve 11 and the photosensitive drum 100. Meanwhile, the heading "Lateral linear stains, Skipped spots" indicates lateral linear stains and skipped spots on an image formed after the developing sleeve 11 has been allowed to stand as described above.

Furthermore, in the heading "Deformation after allowed to stand", characters A, B and C denote no deformation of the developing sleeve 11, substantially no deformation of the developing sleeve 11 and occurrence of deformation of the developing sleeve 11, respectively. Meanwhile, in the heading "Contact stability", characters A, B and C denote excellent contact stability, slightly bad contact stability and defective contact stability, respectively. In addition, in the heading "Lateral linear stains, Skipped spots", characters A, B and C denote no occurrence of the defects, slight occurrence of the defects and no occurrence of the defects, respectively.

From Table 5, it is seen that when the developing sleeve 11 and the photosensitive drum 100 are held in light contact or out of contact with each other such that the gap Ds assumes about +1.0 mm or more, deformation of the developing sleeve 11 after having been allowed to stand as described above is not problematical. Furthermore, when the AC voltage and the DC voltage are applied at the time of drive of the developing device, an excellent image free from lateral linear stains or skipped spots can be obtained.

Hereinbelow, a fourth embodiment of the present invention is described. The fourth embodiment of the present invention relates to a developing device in which a developing sleeve having an inside diameter slightly larger than an outside diameter of a drive roller is fitted around the drive roller and each of opposite axial end portions of the developing sleeve is pressed against the drive roller at one side of the drive roller by a press member such that a sag portion of the developing sleeve formed at the other side of the drive roller is brought into contact with an electrostatic latent image support member, wherein supposing that character $\alpha$ denotes an angle formed between a line connecting a center of the electrostatic latent image support member and a center of the drive roller and a line connecting the center of the drive roller and a radial end of the press member disposed, in a rotational direction of the developing sleeve, upstream of a location where the sag portion is held in contact with the electrostatic latent image support member and character $\Delta L$ denotes a difference between an outside diameter of the developing sleeve and that of the drive roller, the equation:

$$\Delta L \leqq (117/\alpha) - 0.7$$

is satisfied.

By the above arrangement, even if the developing sleeve 11 is made of material having a Young's modulus E of 500 Kg/mm$^2$ or less, for example, material mainly composed of synthetic resin, amount of deformation of the developing sleeve 11 through contact of the developing sleeve 11 with the electrostatic latent image support member is minimized and in addition, the.. developing sleeve 11 can be brought into contact with the electrostatic latent image support member stably and uniformly. As a result, even after operation after the developing sleeve has been allowed to stand for a long period not to mention during ordinary operation, an excellent image free from skipped spots can be obtained stably.

Figure 23:
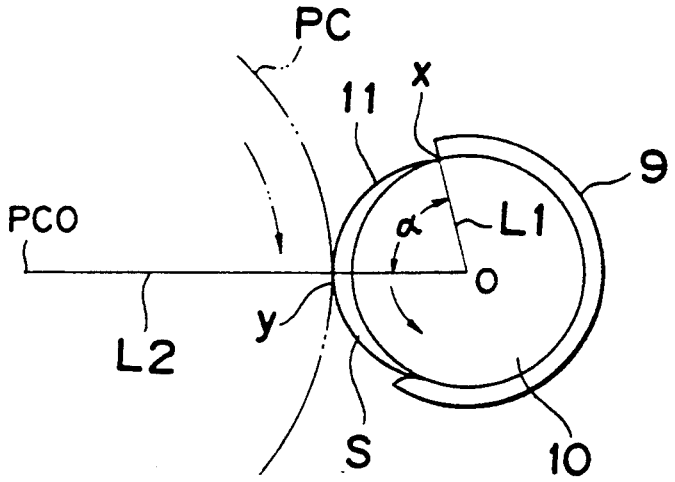
FIG. 23 is a view explanatory of contact of a developing sleeve with a photosensitive drum in a printer incorporating a developing device according to a fourth embodiment of the present invention.

In the developing device 1 of FIG. 5, each of the opposite axial ends of the developing sleeve 11 is brought into pressing contact with the drive roller 10 by the guide member 9 and thus, the sag portion S is formed so as to be directed outwardly from the developing device 1. As shown in FIG. 23, the sag portion S is brought into contact, at a location y, with the photosensitive drum PC acting as the electrostatic latent image support member.

TABLE 6

| | Diameter of drive roller (mm) | $\Delta L$ (mm) | $\alpha$ (°) | Image quality |
|---|---|---|---|---|
| Comparative example 1 | 23.75 | 1.1 | 100 | x |
| Comparative example 2 | " | " | 90 | x |
| Comparative example 3 | " | " | 75 | x |
| Concrete example 1 | " | " | 62.5 | o |
| Concrete example 2 | " | " | 47.5 | o |
| Comparative example 4 | 24.00 | 0.85 | 100 | x |
| Comparative | " | " | 85 | x |

TABLE 6-continued

| | Diameter of drive roller (mm) | ΔL (mm) | α (°) | Image quality |
|---|---|---|---|---|
| example 5 | | | | |
| Concrete example 3 | " | " | 70 | o |
| Concrete example 4 | " | " | 62.5 | o |
| Comparative example 6 | 24.25 | 0.6 | 100 | x |
| Concrete example 5 | " | " | 90 | o |
| Concrete example 6 | " | " | 62.5 | o |

In FIG. 23, a line L1 connects a center O of the drive roller 10 and a radial end x of the guide member 9 disposed upstream of the location y in the counterclockwise direction, i.e. in the rotational direction of the developing sleeve 11. Meanwhile, a line L2 connects the center O of the drive roller 10 and a center PCO of the photosensitive drum PC. An angle α is formed between the lines L1 and L2. Assuming that character ΔL denotes a difference between an outside diameter of the developing sleeve 11 and the that of the drive roller 10, the angle α and the difference ΔL are changed as concrete examples 1-6 and comparative examples 1-6 as shown in Table 6 above and FIG. 24. In Table 6, the developing sleeve 11 has an outside diameter of 24.85 mm.

Meanwhile, in the following examples, the developing sleeve 11 has an outside diameter of 24.85 mm and a thickness of 150 μm and is mainly made of material obtained by blending polyamide 12 (nylon 12) and amorphous polyamide 12 (amorphous nylon 12) at a ratio of 4 to 6. On the other hand, the drive roller 10 is made of silicone foam rubber.

The toner employed in the developing device 1 is charged to negative polarity and is manufactured as follows. Namely, composition consisting of 100 parts by weight of bisphenol A polyester resin having an acid value AV of 19, a hydroxyl value OHV of 23, a softening point of 123° C. and a glass transition point Tg of 65° C., 5 parts by weight of carbon black "IMA#8" (brand name of Mitsubishi Chemical Industries Ltd. of Japan), 3 parts by weight of "Bontron S-34" (brand name of Orient Kagaku Kogyo Co., Ltd. of Japan) and 2.5 parts by weight of "Biscol TS-200", (brand name of Sanyo Chemical Industries, Ltd. of Japan) are kneaded, ground and classified such that toner particles having an average particle diameter of 10 μm and distributed 80 wt. % in an range between 7 and 13 μm. Subsequently, 0.75 part by weight of hydrophobic silica "Tullanox 500", (brand name of Tulco Co.) acting as fluidizer is added to the toner particles and then, is mixed and agitated at 2,000 r.p.m. by a homogenizer.

In FIG. 13, a system speed of the printer is 35 mm/sec., a pressing contact force of the blade 12 is about 3 g/mm, a peripheral speed of the developing sleeve 11 is 105 mm/sec. and only the DC developing bias voltage is applied. After the developing sleeve 11 and the drum PC have been allowed to stand in contact with each other at 35° C. and at a relative humidity of 85% for 90 hours, printing of solid images each occupying a whole face of the transfer paper sheet is performed such that an inspection is made on whether the image has skipped spots or lateral linear stains.

Figure 24:
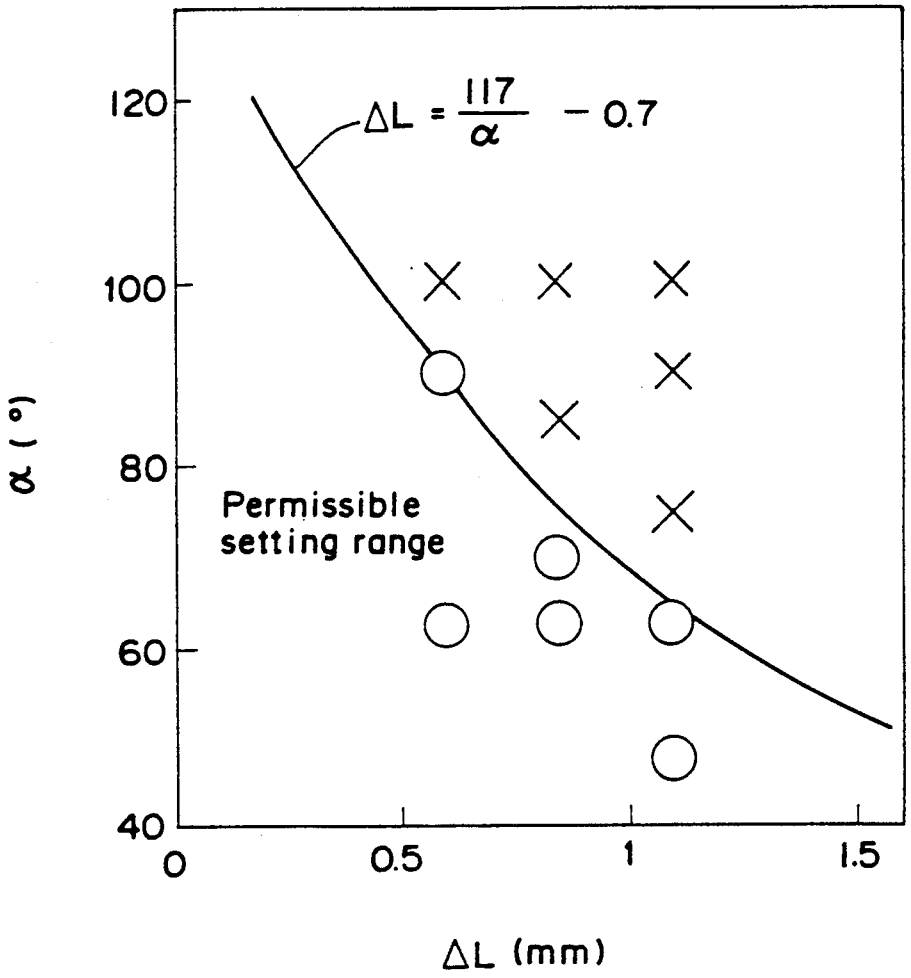
FIG. 24 is a graph showing a permissible setting range of angle $\alpha$ and difference $\Delta L$ of the developing device of FIG. 23.

In Table 6 and FIG. 24, character o denotes excellent image quality, while character x denotes poor image quality having skipped spots or lateral linear stains. It will be understood from Table 6 and FIG. 24 that an excellent image can be obtained in a range satisfying $\{\Delta L \leqq (117/\alpha) - 0.7\}$.

Then, a fifth embodiment of the present invention is described. The fifth embodiment of the present invention relates a developing device in which a toner support member formed, on its surf ace, with a non-magnetic monocomponent toner layer is brought into contact with an electrostatic latent image support member so as to develop an electrostatic latent image, wherein the toner support member has a surface resistivity of $10^{11}$ Ω/□ and an inner portion of the surface of the toner support member is formed by an electrically conductive elastic material such that the toner layer is brought into contact with the electrostatic latent image support member under elasticity of the inner portion of the toner support member, wherein a developing bias of both an AC voltage and a DC voltage is applied to the toner layer through the inner portion of the toner support member such that frequency of the developing bias can be changed over in accordance with a particle diameter of toner in the developing device.

The developing bias is applied to the toner layer through the inner portion of the toner support member on the following ground. Namely, if the developing bias is directly applied to the surface of the toner support member, effective voltage varies in the axial direction of the toner support member under influence of time constant and nonuniformity in density is produced in the axial direction of the toner support member in the case of an analog image including a photographic image.

Even when the developing bias is applied to the surface layer through the electrically conductive inner portion of the toner support member, nonuniformity in image density is likely to be produced if resistance of the surface layer is too high. Meanwhile, when resistance of the surface layer is rather high, electric charge is apt to be stored, so that density of the developed image drops and thus, means for removing stored electric charge is required to be provided. Accordingly, it is desirable that surface resistivity of the toner support member should be $10^{11}$ Ω/□ at most.

Figure 28A:
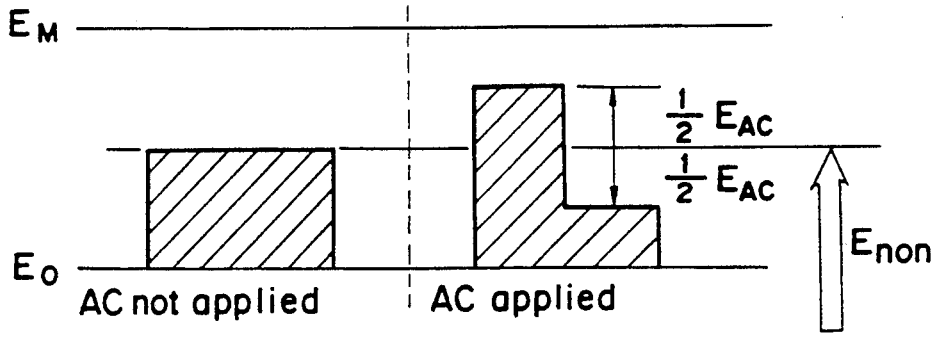
FIGS. 28*a*, 28*b* and 28*c* are views explanatory of a principle that $\gamma$ is reduced when a developing bias includes both an AC voltage and a DC voltage.
Figure 28B:
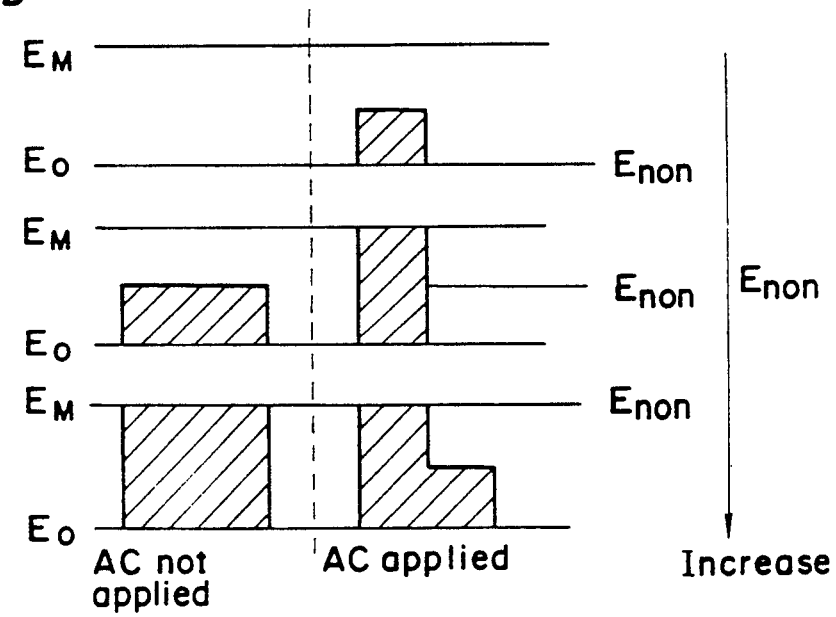
Figure 28C:
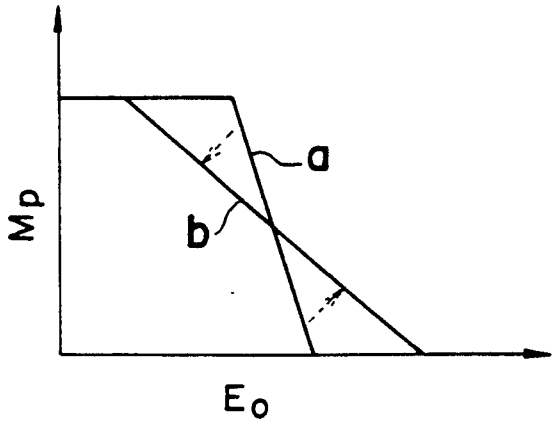

The developing bias of both the AC voltage and the DC voltage is applied for the purpose of improving reproducibility of a halftone image by correcting γ characteristics in the direction of reduction of γ. When the developing bias of both the AC voltage and the DC voltage is applied, γ is reduced possibly on the following ground. Namely, assuming that characters $M_P$ denote amount of toner to be developed, characters $E_O$ denote an external applied electric field in which development of the toner on the developing sleeve starts, characters $E_M$ denote an external applied electric field in which all the toner on the developing sleeve is developed, characters $E_{NON}$ denote an external applied electric field in which only the DC voltage is applied and characters $E_{AC}$ denote an external applied electric field in which both the AC voltage and the DC voltage are applied, the amount $M_P$ of the developed toner is illustrated as shown in FIG. 28*a*. In FIGS. 28*a* and 28*b*, the hatched portions illustrate the amount $M_P$ of the toner. If the external applied electric field $E_{NON}$ varies at this time, the amount $M_P$ of the developed toner changes as shown in FIG. 28*b*. Thus, relation between the amount $M_P$ of the developed toner and the external applied electric field $E_O$ is obtained as shown in FIG. 28*c* from FIGS. 28*a* and 28*b*. In FIG. 28*c*, the line a represents a case in which only the DC voltage is applied, while the line b represents a case in which both the AC voltage and the DC voltage are applied. It is apparent from FIG. 28*c* that gradient of the line b is gentler than that of the line a and thus, reduction of $\gamma$ is effected in the line b.

Figure 25:
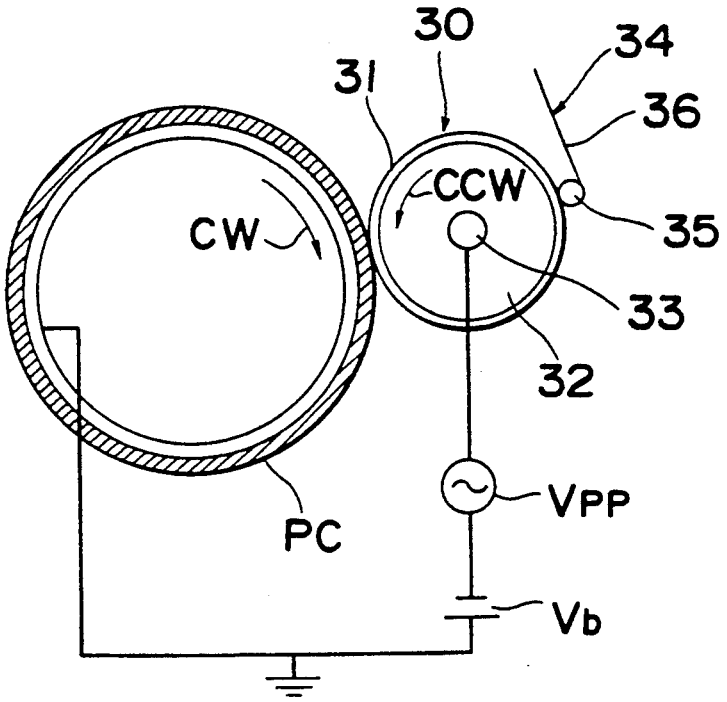
FIG. 25 is a schematic sectional view of a printer incorporating a developing device according to a fifth embodiment of the present invention.

FIG. 25 shows the developing device according to the fifth embodiment of the present invention. This developing device is mounted on a reader printer and is arranged to perform inverted development. The developing device includes a roller type toner support member 30. The toner support member 30 is constituted by a developing sleeve 31 formed by a flexible thin film, an elastic and electrically conductive rubber roller 32 provided inside the developing sleeve 31 and a roller shaft 33 made of electrically conductive metal.

The developing sleeve 31 is made of nylon resin and has a surface resistivity of $10^8$ to $10^{10}$ $\Omega/\square$ and an outside diameter of 25 mm. The rubber roller 32 has an outside diameter of 24 mm. By elasticity of the rubber roller 32, the developing sleeve 31 is brought into contact with an organic photoconductor PC having an outside diameter of 50 mm. Meanwhile, a toner regulating member 34 is brought into contact with the developing sleeve 31 and includes a metallic rod 35 and a metallic blade 36 for supporting the rod 35. The rod 35 has a circular cross section and is brought into contact with the developing sleeve 31 over almost its entire length in the direction of the axis of the roller shaft 33.

The roller shaft 33 and the rubber roller 32 are driven for their rotation in the counterclockwise direction in FIG. 25 by a drive means (not shown) and thus, the developing sleeve 31 is also driven for its rotation in the same direction by rotation of the roller shaft 33 and the rubber roller 32. The photoconductor PC is driven in the clockwise direction in FIG. 25. Although not specifically shown, a toner supply and agitating roller for supplying to the developing sleeve 31 non-magnetic monocomponent toner charged to negative polarity is provided rearwards of the toner support member 30 so as to be driven for its rotation by the above mentioned drive means (not shown).

A developing bias of both a DC voltage Vb of $-300$ V and an AC voltage Vpp of 500 V having a frequency of 500 Hz is applied to the developing sleeve 31 through the roller shaft 33.

In the developing device referred to above, a portion of the toner supplied to the toner support member 30 by the toner supply and agitating roller passes through the toner regulating member 34 in response to rotation of the toner support member 30 and thus, adheres to the surface of the developing sleeve 31 so as to form a charged toner layer having a predetermined thickness such that the charged toner layer is transported to a developing area. On the other hand, the photoconductor PC is charged to a surface potential Vo of $-550$ V by the corona charger 14. The charged region of the photoconductor PC is subjected to image exposure by the optical system 19 and thus, an electrostatic latent image is formed on the photoconductor PC. When the electrostatic latent image reaches the developing area confronting the toner support member 30, the electrostatic latent image is subjected to inverted development into a visible toner image by the toner on the developing sleeve 31. The visible image thus obtained is transferred onto the transfer paper sheet and fixed thereon.

In the developing device, since the developing bias includes the AC voltage Vpp, reduction of $\gamma$ is achieved, so that even a halftone analog image can be developed with excellent reproducibility. Since the developing bias is applied to the developing sleeve 31 through the electrically conductive rubber roller 32, the developing bias is uniformly applied to the developing sleeve 31 in the direction of the axis of the roller shaft 33 and thus, it becomes possible to prevent production of nonuniformity in image density also in the direction of the axis of the roller shaft 33.

Figure 26:
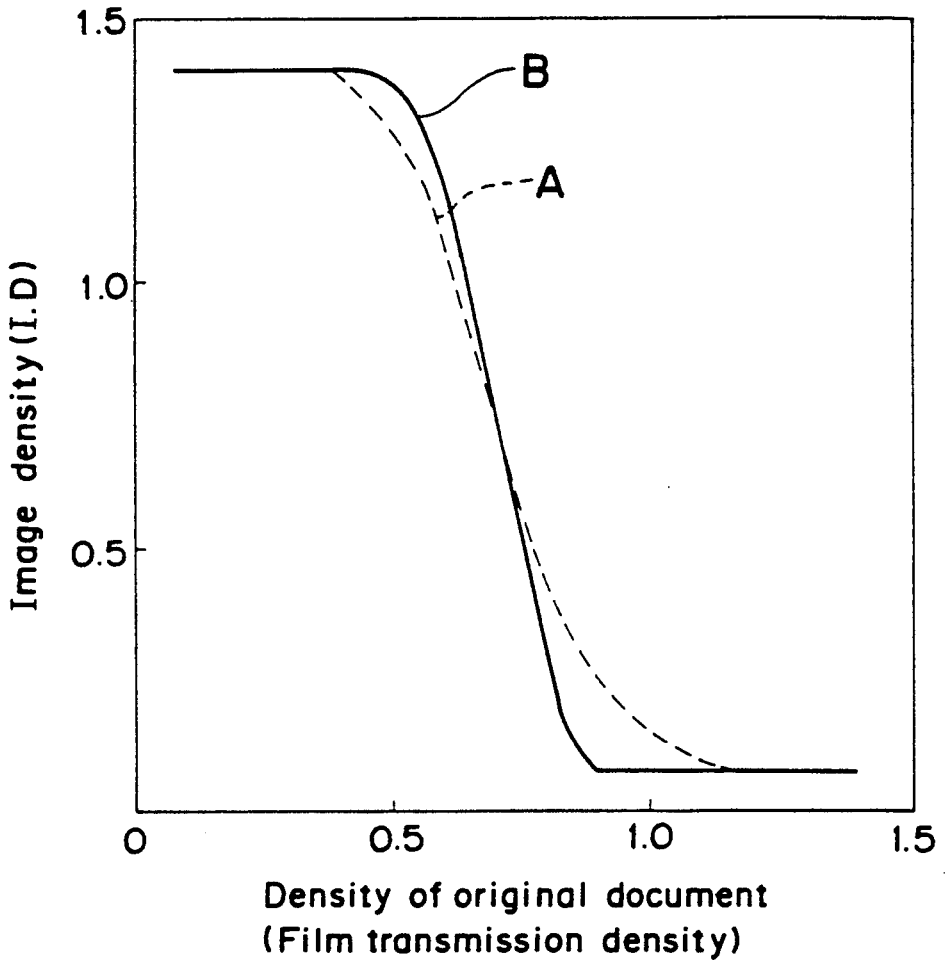
FIG. 26 is a graph showing development characteristics of the printer of FIG. 25.

By using the developing device, the initial surface potential Vo of the photoconductor PC is set at $-550$ V as described above. Then, when image density is examined by variously changing density of original documents (film transmission density) at a fixed quantity of exposure, results shown by the broken line A in FIG. 26 are obtained. Meanwhile, when developing is performed under the same conditions as described above except that the developing bias does not include the AC voltage, results shown by the solid line in FIG. 26 are obtained.

It will be seen from FIG. 26 that gradients of linear and substantially linear portions of the broken line A of the developing device of the present invention are smaller than those of the solid line B and thus, reduction of $\gamma$ is achieved. In comparison with a case in which the developing bias does not include the AC voltage, image density drops in a portion of high image density but rises in a portion of low image density in the developing device of the present invention. Among these factors, since excessive adherence of the toner is restrained by drop of image density at the portion of high image density, consumption of the toner is reduced accordingly.

In accordance with the developing device according to the fifth embodiment of the present invention, reduction of $\gamma$ is achieved, so that not only reproducibility of a halftone image is improved but developing property is excellent. Thus, since the developing device can be operated at such low potentials as a surface voltage Vo of 400–600 V and a DC developing bias Vb of 200–400 V, the latent image is reproduced with fidelity and edge effect is small. Therefore, a desired image can be obtained by lessening inversion noises (so-called black spots) resulting from the photoconductor.

Furthermore, the AC voltage employed for the developing bias is not limited to the AC voltage Vpp of 500 V having the frequency of 500 Hz referred to above. However, the AC voltage should be determined in view of dielectric strength of the photoconductor PC, prevention of fog of image background, etc. If the AC voltage leading to conspicuous reduction of $\gamma$ is selected, it is desirable that the AC voltage be 1 KV or less. Meanwhile, frequency of the AC voltage should be 1 KHz or less preferably. If frequency is higher than 1 KHz, effect for reducing $\gamma$ is lessened. On the contrary, if frequency is low exceedingly, nonuniformity in image density is likely to be appear.

Meanwhile, in the developing device, when particle diameters of the toner are selected through repetitive regulation of the toner by the toner regulating member, only the toner of large particle diameters remains gradually. However, if the toner of large particle diameters increases in amount, charging quantity of the toner drops, so that the above mentioned rise of image density takes place. Even if the developing bias including both the AC voltage and the DC voltage is applied in this state, it is difficult to reduce $\gamma$. Therefore, at the time of empty toner when the toner increase in amount or in a similar state, it may also be considered that frequency of the AC voltage is changed over to a low value. Supposing that the toner has a volume average particle diameter of 10 to 11 $\mu$m in ordinary state and particle diameter of the toner is increased to 15 to 16 $\mu$m, the frequency of 500 Hz may be lowered to 300 Hz or so. If particle diameter of the toner is increased further, charging quantity of the toner decreases and thus, image density is apt to rise. Therefore, in order to compensate for such a phenomenon, it may also be considered that the developing bias is changed over to a low value.

Particle diameter of the toner in the developing device is associated with amount of the consumed toner and thus, can be determined by using a toner empty sensor or detecting the printable number of the transfer paper sheets.

Meanwhile, it is desirable that the developing bias is applied such that frequency S Hz of the developing bias, particle diameter d $\mu$m of the toner and peripheral speed V mm/sec. of the photoconductor satisfy the following equation.

$$V/(12d) \leqq S \leqq V/(10d)$$

Figure 27:
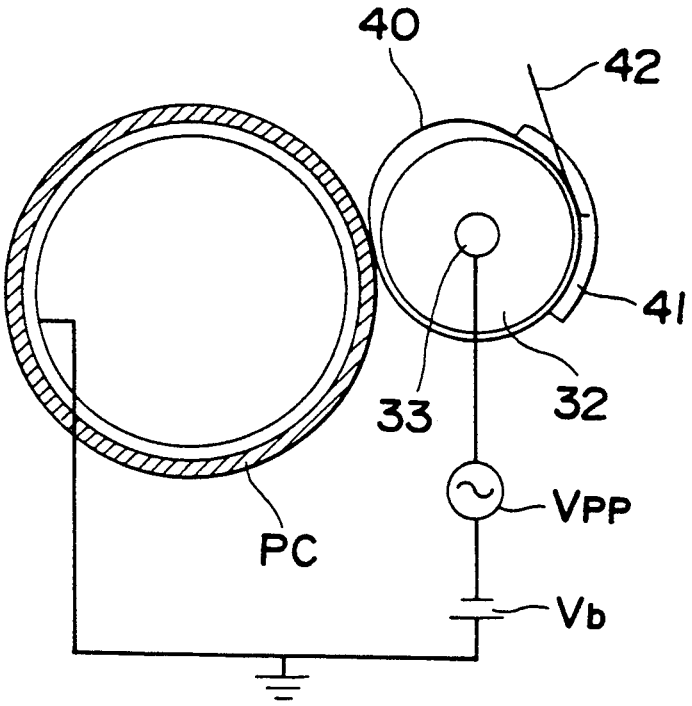
FIG. 27 is a view similar to FIG. 25, particularly showing a modification thereof.

Furthermore, the developing device according to the fifth embodiment of the present invention is not limited to the arrangement of FIG. 25 but may also employ the arrangement of FIG. 27. In FIG. 27, a developing sleeve 40 has an inside diameter slightly larger than an outside diameter of the electrically conductive rubber roller 32. In this case, each of opposite axial end portions of the developing sleeve 41 is pressed against the rubber roller 32 by a press member 41. Thus, the developing sleeve 41 is driven for its rotation by rotation of the rubber roller 32 and is brought into contact with the photoconductor PC by elasticity of the rubber roller 32.

Although the present invention has been fully described by way of example with reference to the accompanying drawings, it is to be noted here that various changes and modifications will be apparent to those skilled in the art. Therefore, unless otherwise such changes and modifications depart from the scope of the present invention, they should be construed as being included therein.

What is claimed is:

1. A developing device comprising:

a drive roller which is driven so as to be rotated;

a developing sleeve which is formed by a thin film and has a peripheral length slightly larger than that of said drive roller so as to be loosely mounted around said drive roller;

a press means which presses said developing sleeve against said drive roller at one side of said drive roller so as to form a sag portion of said developing sleeve such that said sag portion is brought into contact with an electrostatic latent image support member; and an electric field forming means for forming an alternating electric field such that an attractive force capable of bringing said developing sleeve and said electrostatic latent image support member into contact with each other is applied between said developing sleeve and said electrostatic latent image support member.

2. A developing device as claimed in claim 1, wherein said developing sleeve has a specific resistance of $10^{11}$ $\Omega$·cm or less.

3. A developing device as claimed in claim 1, wherein the alternating electric field has a frequency of 100 Hz to 10 KHz.

4. A developing device as claimed in claim 1, wherein the alternating electric field has a peak-to-peak voltage of 400 to 1,000 V.

5. A developing device as claimed in claim 1, wherein non-magnetic toner is supported on said developing sleeve so as to develop an electrostatic latent image on said electrostatic latent image support member.

6. A developing device as claimed in claim 1, wherein magnetic toner is supported on said developing sleeve so as to develop an electrostatic latent image on said electrostatic latent image support member.

7. A developing device as claimed in claim 1, wherein supposing that character a denotes an angle formed between a line connecting a center of said electrostatic latent image support member and a center of said drive roller and a line connecting the center of said drive roller and a radial end of said press means disposed, in a rotational direction of said developing sleeve, upstream of a location where said sag portion is held in contact with said electrostatic latent image support member and character $\Delta L$ denotes a difference between an outside diameter of said developing sleeve and that of said drive roller, the equation:

$$\Delta L \leqq (117/\alpha) - 0.7$$

is satisfied.

8. An image forming apparatus comprising:

an electrostatic latent image support member;

a developer support member which is brought into contact with said electrostatic latent image support member;

wherein at least one of said electrostatic latent image support member and said developer support member has a flexible surface;

an electric field forming means for forming an alternating electric field such that an attractive force capable of bringing said electrostatic latent image support member and said developer support member into contact with each other is applied between said electrostatic latent image support member and said developer support member; and a changeover means for changing over said electric field forming means to a connective state or a nonconnective state.

9. An image forming apparatus as claimed in claim 8, wherein said developer support member includes a drive roller and a developing sleeve, said drive roller being driven so as to be rotated, while said developing sleeve is formed by a thin film and has a peripheral length slightly larger than that of said drive roller so as to be fitted around said drive roller.

10. An image forming apparatus as claimed in claim 8, wherein said changeover means changes over said electric field forming means to the nonconnective state and the connective state at the time of reproduction of a line image and a halftone image, respectively.

11. An image forming apparatus as claimed in claim 8, wherein said changeover means changes over said electric field forming means to the nonconnective state and the connective state at the time of output of a two-value image and a multi-value image, respectively.

12. A developing device comprising:

a drive roller which is driven so as to be rotated;

a developing sleeve which is formed by a thin film and has a peripheral length slightly larger than that of said drive roller so as to be loosely mounted around said drive roller;

a press means which presses said developing sleeve against said drive roller at one side of said drive roller so as to form a sag portion of said developing sleeve such that said sag portion is brought into contact with an electrostatic latent image support member;

an electric field forming means for forming alternating electric field such that an attractive force for bringing said developing sleeve and said electrostatic latent image support member into close contact with each other is applied between said developing sleeve and said electrostatic latent image support member; and a changeover means for effecting changeover between a first state in which said developing sleeve and said electrostatic latent image support member are held in close contact with each other and a second state in which said developing sleeve and said electrostatic latent image support member are held out of close contact with each other.

13. A developing device as claimed in claim 12, wherein said changeover means brings said developing sleeve and said electrostatic latent image support member into and out of close contact with each other at the time of actuation and stop of said developing device, respectively.

14. A developing device as claimed in claim 12, wherein said changeover means is a switch member for turning on and off said electric field forming means.

15. A developing device comprising:

a drive roller;

a developing sleeve which has an inside diameter slightly larger than an outside diameter of said drive roller so as to be loosely mounted around said drive roller; and a press member for pressing said developing sleeve against said drive roller at one side of said drive roller such that a sag portion of said developing sleeve formed at the other side of said drive roller is brought into contact with an electrostatic latent image support member;

wherein supposing that character $\alpha$ denotes an angle formed between a line connecting a center of said electrostatic latent image support member and a center of said drive roller and a line connecting the center of said drive roller and a radial end of said press member disposed, in a rotational direction of said developing sleeve, upstream of a location where said sag portion is held in contact with said electrostatic latent image support member and character $\Delta L$ denotes a difference between an outside diameter of said developing sleeve and that of said drive roller, the equation:

$$\Delta L \leqq (117/\alpha) - 0.7$$

is satisfied.

16. A developing device comprising:

a toner support member which is formed, on its surface, with a non-magnetic monocomponent charged toner layer and is brought into contact with an electrostatic latent image support member so as to develop an electrostatic latent image;

wherein said toner support member has a surface resistivity of $10^{11}$ $\Omega/\square$ or less and an inner portion of the surface of said toner support member is formed by an electrically conductive elastic material such that the toner layer is brought into contact with said electrostatic latent image support memberr under elasticity of the inner portion of said toner support member;

means for applying a developing bias of both an AC voltage and a DC voltage to the toner layer through the inner portion of said toner support member such that frequency of the developing bias can be changed over in accordance with a particle diameter of toner in said developing device.

17. A developing device as claimed in claim 16, wherein the frequency of the developing bias is changed over to a smaller value as the particle diameter of the toner in said developing device is increased further.

18. A developing device as claimed in claim 16, wherein supposing that character S denotes the frequency of the developing bias expressed in Hz, character d denotes the particle diameter of the toner expressed in $\mu$m and character V denotes a rotational speed of said electrostatic latent image support member expressed in mm/sec., the relation:

$$v/(12d) \leqq S \leqq v/(10d)$$

is satisfied.

* * * * *